US005953002A

United States Patent [19]

Hirai et al.

[11] Patent Number: 5,953,002

[45] Date of Patent: Sep. 14, 1999

[54] DRIVING METHOD FOR A LIQUID CRYSTAL DISPLAY DEVICE

[75] Inventors: Yoshinori Hirai; Akira Nakazawa; Makoto Nagai; Takeshi Kuwata; Hiroyuki Motegi; Kazuyoshi Kawaguchi, all of Yokohama, Japan

[73] Assignee: Asahi Glass Company Ltd., Tokyo, Japan

[21] Appl. No.: 08/628,634

[22] PCT Filed: Aug. 22, 1995

[86] PCT No.: PCT/JP95/01656

§ 371 Date: Apr. 17, 1996

§ 102(e) Date: Apr. 17, 1996

[87] PCT Pub. No.: WO96/06423

PCT Pub. Date: Feb. 29, 1996

[30] Foreign Application Priority Data

| | | | |
|---|---|---|---|
| Aug. 23, 1994 | [JP] | Japan | 6-198766 |
| Aug. 24, 1994 | [JP] | Japan | 6-199908 |
| Dec. 20, 1994 | [JP] | Japan | 6-317027 |
| May 19, 1995 | [JP] | Japan | 7-121415 |

[51] Int. Cl.[6] ..... G09G 5/00

[52] U.S. Cl. ..... 345/204; 345/147; 345/89

[58] Field of Search ..... 345/89, 100, 95, 345/94, 204, 147, 93, 210, 148, 211, 149

[56] References Cited

U.S. PATENT DOCUMENTS

| | | | |
|---|---|---|---|
| 5,262,881 | 11/1993 | Kuwata et al. . | |
| 5,489,919 | 2/1996 | Kuwata et al. . | |
| 5,548,302 | 8/1996 | Kuwata et al. . | |
| 5,596,344 | 1/1997 | Kuwata et al. . | |
| 5,642,133 | 6/1997 | Schepper et al. | 345/147 |
| 5,644,329 | 7/1997 | Asari et al. . | |
| 5,682,177 | 10/1997 | Kuwata et al. . | |

FOREIGN PATENT DOCUMENTS 0569974 12/1993 European Pat. Off. .

*Primary Examiner*—Richard A. Hjerpe
*Assistant Examiner*—Francis N. Nguyen
*Attorney, Agent, or Firm*—Oblon, Spivak, McClelland, Maier & Neustadt, P.C.

[57] ABSTRACT

A driving method for a direct addressing type liquid crystal display device for displaying gradation by changing the amplitude of voltages applied to pixels, wherein a series of voltage pulses, as signal voltages, composed of a plurality of different voltage levels are applied in order to display a specified gradation, and for a display, a plurality kinds of gradation in which a part of the voltage levels is commonly used are selected.

19 Claims, 10 Drawing Sheets

DRIVING METHOD FOR A LIQUID CRYSTAL DISPLAY DEVICE

BACKGROUND OF THE INVENTION

1. Field of the Invention

The present invention relates to a driving method for a passive addressing type liquid crystal display device.

2. Discussion of the Background

As a basic driving method for a passive (multiplexed) addressing type liquid crystal display element, there has been proposed a line successive selection method (for instance, APT: Alt Pleshko Technique) or IAPT (Improved Alt Pleshko Technique as an improvement of APT). This technique is very useful as a multiplex driving method since ON-OFF levels can be easily driven. However, since the direct addressing type liquid crystal display device does not use active elements such as TFTs, there was a problem of reduction of contrast ratio due to frame response when a liquid crystal display element of fast response was used.

In order to solve such problem, a multiple line selection method has been proposed whereby it has been possible to display a picture having a high contrast ratio at a high speed. Further, in order to achieve the same purpose as described above, an attempt of using a whole line simultaneous selection method (AA: Active addressing) has been reported. Thus, a new addressing technique has been developed with the result of improving a quality of display.

There has been an increased demand for displaying pictures with many gradation levels for personal computers, TVs etc. and liquid crystal display devices as well. Several methods have been used for displays with gradation. In an active type driving method using transistors, diodes, or the like, an amplitude modulation can be easily achieved by using voltage pulses whose pulse height is varied depending on gradation levels of data to be displayed. This is because voltages applied to liquid crystal are basically of a static waveform.

In a passive multiplexed type driving method which typically uses a STN (super-twisted nematic) liquid crystal element and so on, however, there is a voltage change in a non-selection time when voltage pulses whose pulse height is varied depending on gradation levels of data to be displayed are simply applied to the element. Under the circumstances, there have been used or proposed several methods to display gradation levels in the passive multiplexed type driving method.

In the conventional driving methods of driving STN, there have been proposed and used a frame rate control method (FRC) and a pulse width modulation method (PWM) in order to obtain a display with gradation. Recently, an amplitude modulation method (AM) has been proposed. In the following, description will be made briefly on the proposed methods, and then, description will be made on problems caused when these methods are applied to the multiple line selection method.

(1) Frame rate control (FRC)

A gradation display is made with use of a plurality of frames. Namely, an intermediate tone is formed in response to the number of ON and OFF as a binary state. For instance, when three frames are used, four states, ON/ON/ON, ON/OFF/ON, OFF/ON/OFF and OFF/OFF/OFF can be displayed.

However, when a picture having many gradation levels is to be displayed with use of the FRC method, there may cause a flicker because an increased number of frames takes a long time to complete a display. Practically, the FRC method is combined with a spatial modulation method for shifting spatially phases to thereby avoid the occurrence of the flicker. However, the proposed method is considered to be difficult to obtain a picture having more than 16 gradation levels.

Another important problem in the FRC method resides in difficulty in applying it to a video display. For instance, in a display of dynamic picture, the display should be completed in a period in which a dynamic picture is changed. Accordingly, it is impossible to use many frames, and a display of many gradation levels is difficult.

For instance, when a frame frequency of 120 Hz (a generally used frequency, and the length of a frame is 8.3 ms) is used and a dynamic picture of 30 pictures per sec.(30 Hz) is to be displayed, it is necessary to complete the display in 4 frames. In this case, the number of gradation levels which can be displayed is only about 5 to 8. Thus, the FRC method was insufficient to display a dynamic picture having many gradation levels.

(2) Pulse width modulation (PWM)

In this method, a selection time period is divided into, for instance, a $2^n$ number of sub-periods, and an ON state and an OFF state are distributed to the sub-periods. This method can be considered as such a technique that the FRC method is carried out in a frame. However, this method has a drawback that ununiformity becomes large in a display as the density and the gradation levels of a display is increased because the driving frequency is increased in proportion to the number of divided time periods.

(3) Amplitude modulation (AM)

As described before, it is impossible to multiplexed driving the passive addressing type LCD by simply applying voltage pulses whose pulse height is varied depending on gradation levels of data to be displayed, and it is necessary to avoid a change of the effective voltage to pixels in a non-selection time. For this purpose, there have been proposed two techniques: application of a plurality of voltages and use of an imaginary electrode.

In the former technique, different data (column) voltages are applied to two or more frames, or a selection time period is divided into two or more time periods wherein different data voltages are applied to the divided time periods. The application of a plurality of voltages makes the effective voltage in a non-selection time constant whereby a desired gradation display can be obtained. Specifically, the voltages corresponding to two kinds of data as shown in Formula 1 may be applied to each frame, or the two kinds of voltages may be applied by exchanging them in a selection time period.

Formula 1

$$d+(1-d^2)^{0.5}$$

$$d-(1-d^2)^{0.5}$$

where d indicates display data (ON: −1, OFF: 1)

Hereinbelow, the data shown in Formula 1 are referred to as divided data. The application of only part of the divided data does not render the effective voltage value to be a predetermined constant value, and therefore, addressing is not completed. Accordingly, in a case that the divided data are applied to each of the frames, the frames are referred to as subframes in order to distinguish them from the ordinary frames.

The divided data are featurized by including components which vary depending on gradation levels of data. However, since the divided data respectively include a correction term, $(\pm(1-d_2)^{0.5})$, the effective value of voltages applied to pixels in a non-selection time can be kept constant. New divided data can be produced on the basis of the respective divided data, whereby more than two kinds of divided data can be used.

In this technique, a device capable of supplying a plurality of voltage levels is required. In order to display K gradation levels, voltages of a (2K−2) number of levels are required. Namely, a display of 8 gradation levels requires 14 voltage levels. As the number of gradation levels increases, the number of voltage levels increases. An increased number of voltage levels will cause an increased manufacturing cost. Further, a state of display is basically determined by applying two voltage levels. Accordingly, if a time interval of applying a unit voltage (a width of pulses of a voltage) is made constant, the length of frames for completing a display is twice as in the conventional technique.

Another method of avoiding a change of the effective voltage values to non-selected pixels is to provide at least one line of imaginary electrode, wherein selection lines are driven so as to display data for the imaginary row electrode, or voltage levels which have been imaginary determined may be applied to the selection lines. This method had an advantage that there is no substantial change in frequency because the length of frame is not made double. However, this method has disadvantages that operations with all line data are necessary, and the number of voltage levels to be supplied is remarkably increased due to the sum of the number of gradation levels and the number of correction levels. In particular, the increase of the number of voltage levels is a serious problem which has prevented the spreading of the AM method. The above-mentioned two methods include a technique referred in U.S. Ser. No. 08/098,812 and a technique referred to as a pulse height modulation (PHM) disclosed in Japanese Unexamined Patent Publication No. 89082/1994 (or EP 569974).

As described above, the technique for displaying gradation with use of the amplitude modulation method inevitably caused a complicated circuit structure and the necessity of using drivers for a number of levels, which invited a substantial increase of manufacturing cost.

(4) Problems in multiple line selection method

In the multiple line selection method, the above-mentioned conventional driving method can be utilized with a certain modification. For instance, when a gradation display is conducted in accordance with the amplitude modulation method in addition to using a plurality of divided data, each of the divided data is displayed in accordance with the multiple line selection method whereby a gradation display is possible. Namely, column signals are formed by the orthogonal transformation of the divided data with use of a predetermined selection matrix (an orthogonal matrix).

However, the before-mentioned problem on the gradation display equally takes place in the multiple line selection method. The frequency rate control method (FRC) and the pulse width modulation method (PWM) have the same problem as the successive line selection method concerning the difficulty of obtaining a display having a number of gradation levels. In the amplitude modulation method, an increase of the maximum voltage value and an increased number of voltage levels due to selecting simultaneously a plurality of lines cause more serious problem in comparison with the successive line selection method. In other words, in the multiple line selection method, calculation with use of an orthogonal function is needed whereby a large number of voltage levels are necessary for display. Further, the construction of circuit is complicated. An increased number of gradation levels causes a big problem of pushing up manufacturing cost.

The multiple line selection method utilizing the amplitude modulation method requires a large number of voltage levels even though the number of gradation levels is small and the number of lines simultaneously selected is small. For instance, in a case that the number of gradation levels to be displayed by the AM method is only 8 and each line is successively selected, 12 voltage levels are needed because 6 gradation levels in 8 gradation levels are used for data of intermediate values, and it is necessary to provide voltage levels as twice as the number of data for the intermediate values even in a case that each line is successively selected. In the application of the AM method to the multiple line selection method wherein addition and subtraction of voltage levels are conducted at the time of the orthogonal transformation, the number of voltage levels is fairly increased even though the number of simultaneously selected lines is small. For instance, when L (the number of simultaneously selected lines)=3, voltage levels of about $8^3=512$ are required. Namely, the amplitude modulation in the multiple line selection method requires column drivers of a very high degree of resolution (more than 8 bits, preferably 10–12 bits). If drivers having a smaller number of levels are used, there produces data error.

SUMMARY OF THE INVENTION

It is an object of the present invention to eliminate the disadvantages in the conventional methods which require a large number of voltage levels in comparison with an amount of information of gradation and to provide a driving method for a liquid crystal display device capable of efficiently supplying information and providing a correct gradation display.

In accordance with the present invention, there is provided a driving method for a liquid crystal display device using a multiplex driving method which comprises:

(a) in a display of gradation data, applying to pixels a plurality of voltage pulses including components, in the respective pulse heights, which vary depending on gradation levels of data to be displayed, whereby RMS voltages applied to pixels on scanning electrodes in a non-selection state are effectively made constant in a display frame period, and (b) using a part of the plurality of voltage pulses commonly in at least two data of different gradation level used for display, whereby the number of pulse heights of the voltage levels necessary for display is reduced.

Further, the present invention is to provide a driving method for a liquid crystal display device using a multiplex driving method which comprises:

(a) in a display of gradation data, applying to pixels voltage pulses having pulse heights which correspond to a plurality of gradation data (divided gradation data) including components which vary depending on gradation levels of data to be displayed, whereby RMS voltages applied to pixels on scanning electrodes in a non-selection state are effectively made constant in a display frame period, and (b) using a part of the plurality of divided gradation data commonly in at least two different gradation data used for display.

Further, in any of the above-mentioned driving methods, gradation data are displayed in association with a frame modulation or a pulse width modulation.

Also, in the above-mentioned methods, a plurality of scanning electrodes are simultaneously selected. In particular, when an intermediate gradation data are displayed, signals which are applied to the data electrodes in response to selection pulses in a time period wherein all the scanning electrodes are applied with at least one selection pulse include in a mixed state at least one signal which is obtained by the orthogonal transformation of a data element having the absolute value exceeding 1 among the divided gradation data and at least one signal which is obtained by the orthogonal transformation of a data element having the absolute value less than 1.

Further, in particular, when an intermediate gradation data are displayed, signals which are applied to the data electrodes in response to selection pulses applied once to a simultaneously selected scanning electrode group include in a mixed state at least one signal which is obtained by the orthogonal transformation of a data element having the absolute value exceeding 1 among the divided gradation data and at least one signal which is obtained by the orthogonal transformation of a data element having the absolute value less than 1.

Further, in the method firstly and secondly mentioned, a plurality of scanning electrodes are simultaneously selected, and when signals are applied to the data electrodes with respect to a simultaneously selected scanning electrode group, the signals are formed by the orthogonal transformation of all the divided gradation data necessary for displaying a predetermined gradation data, and the signals are successively applied as a group for each of column vectors of the selection matrix, to the data electrodes in response to a timing of the application of the selection pulses.

In the above-mentioned methods, a plurality of scanning electrodes are simultaneously selected, and at least one imaginary scanning electrode is added to the simultaneously selected scanning electrodes, and data are determined for the imaginary scanning electrode so that the number of voltage levels to be applied to data electrodes is reduced.

In particular, in any of the above-mentioned driving methods, the display data corresponding to the simultaneously selected scanning electrodes (which include at least one imaginary scanning electrodes) are divided into plural groups of display data having different absolute values; and data are determined for the imaginary scanning electrodes so that the number of display data included in each of the groups takes a predetermined discrete integer value. Or, the product of the column vector elements in the selection matrix takes a predetermined sign, and data are determined for the imaginary scanning electrodes so that the product of the display data elements corresponding to the simultaneously selected scanning electrodes (which include at least one imaginary scanning electrode) takes a predetermined sign.

The present inventions provides the following effects.

1) A liquid crystal display device of multi-gradation can be driven with drivers of a practical number of voltage levels (64-32 levels or lower). Namely, remarkable simplification to a circuit system and reduction of manufacturing cost can be achieved in comparison with the conventional technique.

2) A completely independent display is obtainable without data error. A picture image of high quality can be provided without any special treatment to the data. Namely, a picture image free from data error such as crosstalk can be provided.

In the present invention, when gradation is displayed by changing the amplitude of voltages, a series of voltage pulses composed of a plurality of different voltage levels are applied, as signal voltages, in order to display a specified gradation, whereby a change of the effective voltages to be applied to non-selected pixels is prevented. "A plurality of voltage levels" can be determined by various methods.

First, a display data is expressed by a plurality of data, i.e., divided data. A specified gradation can be displayed by displaying the divided data. In a multiple line selection method, column signals are formed by the orthogonal transformation of the data to be displayed. In this case, the order of the division of the data and the orthogonal transformation of the data can be exchanged. In other words, the divided column signals may be formed by forming the divided data before the orthogonal transformation of the divided data. Or, the data to be displayed are subjected to the orthogonal transformation to thereby form the column signals, and then, the column signals may be expressed with a plurality of divided column signals.

Further, a single correction column signal may be applied for simultaneously selected lines. In this case, the correction column signals may be treated as data on an imaginary line.

DISCUSSION OF THE PREFERRED EMBODIMENTS

Figure 1:
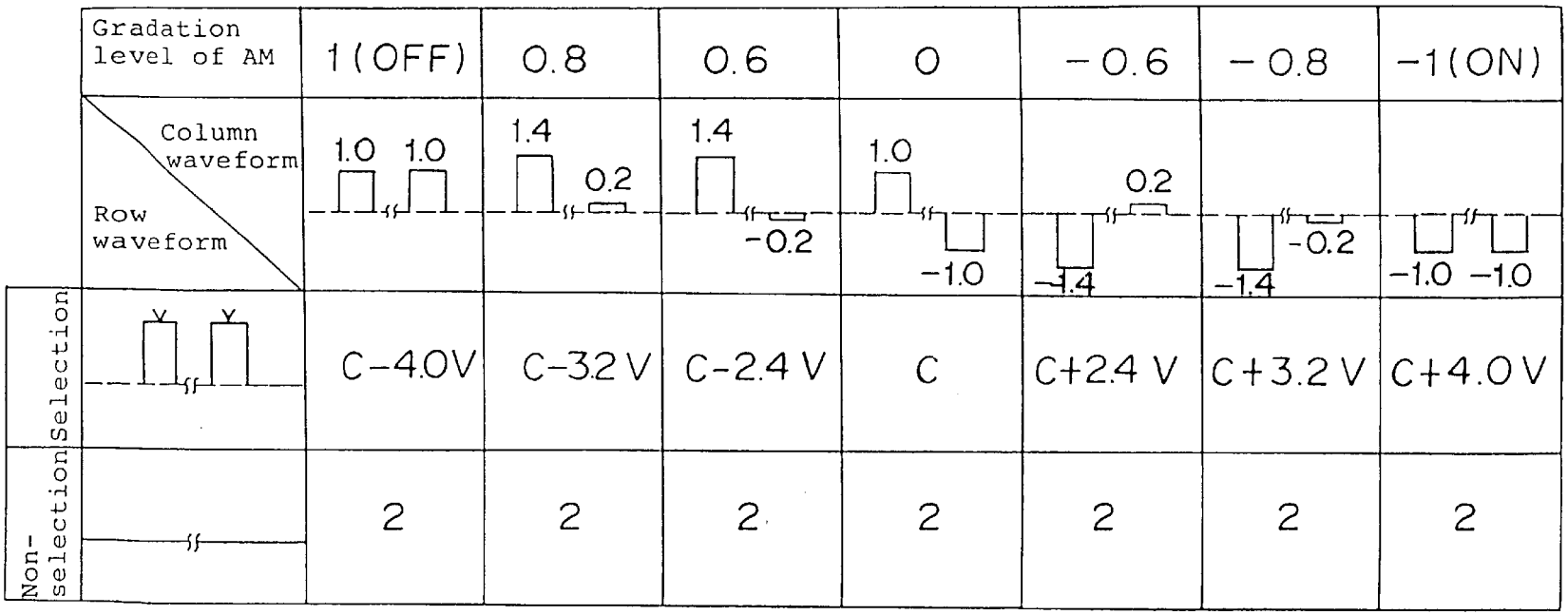
FIG. 1 is a diagram showing voltage values to be applied to pixels with respect to various row waveforms and column waveforms in a combination of $d_1$=0.6 and $d_2$=0.8 according to the present invention.

The present invention is to propose an amplitude modulation (AM) type gradation driving method by which a much increase of the number of voltage levels necessary to the number of gradation levels is avoidable and a gradation display is effected with the number of voltage levels in minimum requirement.

The present invention is applicable to all kinds of AM methods. The AM methods include a method as disclosed in U.S. Ser. No. 08/098,812 filed by the applicant of this application and a method as in EP 569974. The two methods propose some solutions in the infinite number of solutions in the AM methods. Namely, a method of displaying gradation data by applying to pixels a plurality of voltage pulses including components, in the respective crest values, which vary depending on gradation levels of data to be displayed, is expressed by the following conditions.

In a case that an L (more than or equal to 1) number of scanning electrodes are simultaneously selected, and an orthogonal function signals A [Ami] (where Ami are elements, i.e., 1, −1 and 0, in m rows and i columns in the orthogonal matrix A; m is an integer of 1−L, and i is an integer of 1−M, which corresponds to the i th selection signal in a display cycle) are used as signals applied to the selected scanning electrodes, and when there is $(C_1, C_2, \ldots, C_M)=(d_1, d_2, \ldots, d_L)$ A to obtain predetermined gradation level $d_j$ ($d_j$ takes a value between 1 indicating OFF and −1 indicating ON depending on gradation levels) with respect to the pixel on the j th (j is an integer of 1−L) line in a simultaneously selected group of electrodes concerning a specified column, the column is substantially applied with a voltage in proportion to two kinds of voltages expressed by the following Formula 2:

Formula 2

$$X_i=C_i+(q_i-C_i^2)^{1/2}$$

$$Y_i=C_i-(q_i-C_i^2)^{1/2}$$

where $\Sigma q_i$=constant≧tr [$^t$AA] (where t indicates the transposition of the matrix, and tr [ ] indicates the sum of diagonal components in the matrix of [ ] ).

The method disclosed in U.S. Ser. No. 08/098,812 by the applicant is a case that $\Sigma q_i$=tr [$^t$AA], and $q_i$ is equal to all i. In methods disclosed in EP 569974, the method called "Split interval mode" is such that $q_i$ is determined with change of i in order to meet the gradation display method using a pulse width modulation method. In these methods, voltage pulses having different values are used.

Although, the present invention is widely applicable to all AM methods, a driving method using two levels in Formula 1 will be exemplified for simplification of explanation.

In the successive line selection method (or APT method), a display of specified gradation levels can effectively be expressed by adding two levels as described in Formula 1.

In the present invention, a plurality of gradation levels are expressed with use of the same level elements so that the number of voltage levels used can be reduced as a whole. The idea of the present invention is that gradation levels having special values are selected for display. On the contrary, the idea of the conventional technique is that gradation levels are determined based on the bit number of input signal and a specification of treating circuits. Namely, if a part of divided data of two different display data is commonly used, the number of voltage levels required is not increased so much. For instance, when two sets of display data ($\pm d_1$, $\pm d_2$) are added to display gradation levels other than ON, OFF and 50% gray (which can be expressed by ON+OFF), and the number of voltage levels required must not be increased beyond the number of gradation levels increased, the condition described in Formula 3 should be satisfied. From Formula 3, the condition of Formula 4 is introduced.

Formula 3

$$|d_1+(1-d_1^2)^{0.5}|=|d_2+(1-d_2^2)^{0.5}|$$

Formula 4

$$d_1^2(1-d_1^2)^{0.5}=d_2^2(1-d_2^2)^{0.5}$$

wherein $d_1 \neq d_2$

In Formula 4, $d_1$ and $d_2$ are expressed by the square of the data values and are symmetrical with respect to positive and negative signs. Accordingly, the four gradation levels of $\pm d_1$, $\pm d_2$ can be displayed by adding four voltage levels. Table 1 shows an example of the pair of $d_1$ and $d_2$.

TABLE 1

| | | | | | | |
|---|---|---|---|---|---|---|
| $d_1$ | 0.2 | 0.3 | 0.4 | 0.5 | 0.6 | 0.7 |
| $d_2$ | $(0.96)^{0.5}$ | $(0.91)^{0.5}$ | $(0.84)^{0.5}$ | $(0.75)^{0.5}$ | 0.8 | $(0.51)^{0.5}$ |

When a certain gradation data $d_1$ (and $-d_1$) is used, $d_2(=(1-d_1^2)^{0.5})$ is used as the partner of $d_1$, whereby the number of required voltage levels can be made the same as the increased number of gradation levels. Such combination of gradation levels can not generally be obtained based on a conventionally used display using 8 gradation, 16 gradation, 32 gradation or the like.

In the conventional technique, the pulse heights corresponding to gradation levels do not coincide, and when they are driven by drivers having a smaller number of voltage levels, there is a high possibility of data errors.

In accordance with the method of the present invention, the number of levels required with respect to the number of gradation levels K is expressed by Formula 5.

Formula 5

$$(K-2)+2=K$$

Accordingly, reduction in the number (K−2) levels is possible in comparison with the conventional system requiring (2K−2) levels. Incidentally, with use of a voltage level of ±1, data "0" (50% gray) can be displayed.

As described before, a display can be completed by displaying the divided display data with two subframes. As the display data displayed by using the amplitude modulation method, there are provided ON (d=−1), OFF (d =+1), 50% gray (d=0), (however, d=0 is not essential in the present invention), and four data are selected so as to satisfy the condition of Formula 4. Namely, it consider that ±1, $\pm d_1$ and $\pm d_2$ $(=\pm(1-d_1^2)^{0.5})$ (and 0) are used as gradation levels. In this case, two divided data necessary to express each of the display data are shown in Table 2 where the meaning of $X_0$ and $Y_0$ are shown in Formula 6.

TABLE 2

| Display data | Divided data 1 | Divided data 2 |
|---|---|---|
| 1 | 1 | 1 |
| $d_1$ | $X_0$ | $Y_0$ |
| $d_2$ | $X_0$ | $-Y_0$ |
| 0 | 1 | −1 |
| $-d_2$ | $Y_0$ | $-X_0$ |
| $-d_1$ | $-Y_0$ | $-X_0$ |
| −1 | −1 | −1 |

Formula 6

$$X_0=d_1+(1-d_1^2)^{0.5}$$

$$Y_0=d_1-(1-d_1^2)^{0.5}$$

The order of applying the two divided data may be exchanged, whereby ±1 and $\pm X_0$ are used as the divided data for a subframe, and ±1 and $\pm Y_0$ are used as the divided data for the other subframe. In this case, the subframe using ±1 and $\pm X_0$ is referred to as an X subframe; the divided data used for the X subframe is referred to as divided data X; the subframe using ±1 and $\pm Y_0$ is referred to as a Y subframe, and the divided data used for the Y subframe is referred to as divided data Y. In this case, the divided data X and Y to show each of the display data are as shown in Table 3. From the definition, $X_0$ has an absolute value of more than 1 and $Y_0$ has an absolute value of lower than 1.

TABLE 3

| Display data | X | Y |
|---|---|---|
| 1 | 1 | 1 |
| $d_1$ | $X_0$ | $Y_0$ |
| $d_2$ | $X_0$ | $-Y_0$ |
| 0 | 1 | −1 |
| $-d_2$ | $X_0$ | $Y_0$ |
| $-d_1$ | $-X_0$ | $-Y_0$ |
| −1 | −1 | −1 |

In FIG. 1, there are shown voltage values applied to a pixel with respect to various row waveforms and column waveforms in a case that a combination of $d_1$=0.6 and $d_2$=0.8 in Table 1 is used. In FIG. 1, column voltage levels are shown in normalized form. In FIG. 1, $C=2V^2+2$.

It is understood from FIG. 1 that for instance, gradation levels 0.8 and 0.6 include commonly a pulse height of 1.4 and gradation levels 0.8 and −0.6 include commonly a pulse height of 0.2, and accordingly, four gradation levels of ±0.6 and ±0.8 can be displayed with four levels of ±1.4 and ±0.2. With addition of ±1.0, 7 gradation levels can be displayed with 6 levels of column voltage. In signal voltages applied in a selection time, a portion changing in column voltages is in proportion to the display data d. The RMS voltage in a non-selection time is constant in a display frame.

In the next, attention should be paid to intervals of each gradation level. As is clear from the combination of gradation levels as described above, when the gradation data $\pm d_1$ and $\pm d_2$ are added for display to the display data +1 and −1, the gradation levels are not formed at equal intervals. This is unadvantageous for displaying a continuous gradation.

For displaying a continuous gradation, the present invention proposes use of the AM method in combination with another gradation method, in particular, the FRC method, whereby the number of gradation levels can be remarkably increased. In this case, the combination of $d_1$=0.6 and $d_2$=0.8 in Table 1 is a special solution since data 0.6, 0.8 and 1.0 have values having intervals of 0.2. In other words, the gradation levels constitute a part of the levels formed by dividing a range of from −1 to +1 by substantially equal intervals. Specifically, ±0.2 and ±0.4 are removed from the data having intervals of 0.2 in the range from 1 to −1.

Namely, all the gradation levels of equal intervals are not produced by the amplitude modulation but part of the gradation levels of equal intervals are expressed. Namely, the levels are not closed by only the amplitude modulation.

In this case, with a combination of another gradation display method such as FRC or PWM, the gradation levels of equal intervals can be formed while the number of gradation levels can be remarkably increased.

An example of the combination of FRC for 2 frames will be described. For instance, when 7 gradation levels (1, 0.8, 0.6, 0, −0.6, −0.8, −1: where a display data 0 can be expressed by levels ±1) are displayed by using the AM method, and the FRC method for 2 frames are used in combination, a display of 21 gradation levels can be achieved with a scale of 0.1 in the range from 1 to −1, by the suitable combination of the display data. The value obtained is three times as large as the case without using the FRC method.

Another example of the combination of the gradation data is described. The combination of $d_1$=0.92 and $d_2$=0.392 provides 25 gradation levels when the FRC method for 2 frames (i.e. 4 subframes) is used; 63 gradation levels when the FRC method for 3 frames (i.e. 6 subframes) is used, and more than 100 gradation levels when the FRC method for 4 frame (i.e. 8 subframes) is used.

In comparison, when $K_1$ levels which are values having equal intervals are displayed by the AM method, and the number of gradation levels to be displayed is increased by the FRC method for M frames, a display of $((K_1-1)\times M+1)$ gradation is possible. For instance, when M is 2, a display of $(2K_1-1)$ gradation levels is obtainable. The number of the levels is only less than double as a case without employing the FRC.

When a part of the gradation levels such as ±0.8, ±0.6 which are obtained by the division of a range from +1 to −1 at equal intervals is taken, and a display having a specified gradation level is displayed by using a plurality of frames including the part of the gradation levels, a further increased number of gradation levels can be obtained in comparison with the conventional gradation displaying technique by using a plurality of frames. And, when a part of gradation levels such as ±0.92, ±0.392 having unequal intervals is used for gradation levels in a single frame, the number of gradation levels can be drastically increased as the number of frames is increased.

Table 4 shows an example of data to be put in a first frame and a second frame in order to achieve a display of 21 gradation levels in a combination of $d_1$=0.6 and $d_2$=0.8 wherein 1/21 indicates an OFF voltage and 21/21 indicates an ON voltage. As described before, in accordance with the technique that two kinds of divided data are distributed to each of subframes, the first and second frames are respectively formed of two subframes, and the gradation levels can be expressed by using four subframes in total.

TABLE 4

| Gradation | 1 FR | 2 FR | Gradation | 1FR | 2FR |
|---|---|---|---|---|---|
| 21/21 | −1.0 | −1.0 | 10/21 | −0.8 | 1.0 |
| 20/21 | −1.0 | −0.8 | 9/21 | −0.6 | 1.0 |
| 19/21 | −0.8 | −0.8 | 8/21 | 0.0 | 0.6 |
| 18/21 | −0.8 | −0.6 | 7/21 | 0.0 | 0.8 |
| 17/21 | −0.6 | −0.6 | 6/21 | 0.0 | 1.0 |
| 16/21 | −1.0 | −0.0 | 5/21 | 0.6 | 0.6 |
| 15/21 | −0.8 | −0.0 | 4/21 | 0.8 | 0.6 |
| 14/21 | −0.6 | −0.0 | 3/21 | 0.8 | 0.8 |
| 13/21 | −1.0 | 0.6 | 2/21 | 0.8 | 1.0 |
| 12/21 | −1.0 | 0.8 | 1/21 | 1.0 | 1.0 |
| 11/21 | 0.0 | 0.0 | | | |

Table 5 shows the number of levels required for displaying 7–8 gradation levels according to the present invention and the conventional AM method, and the number of gradation levels formed by combining the FRC method for comparison.

TABLE 5

| | Conventional AM method | Present invention |
|---|---|---|
| Number of voltage levels required | 14 | 6 |
| Number of gradation levels obtained by AM method | 8 | 7 |
| Number of gradation levels obtained by combining FRC method for 2 frames | 15 | 21 |

As shown in Table 5, the conventional technique can provide only a display of 15 gradation levels by using 14 voltage levels. On the other hand, the present invention can provide a display of 21 gradation levels by using 6 voltage levels. The efficiency of gradation/level of the present invention is more than 3 times as large as the conventional technique. This means a dramatic improvement of the quality of displays without a substantial increase of manufacturing cost.

Further, in accordance with the present invention, much more number of gradation levels is obtainable with a smaller number of frames by using two or more sets of gradation data. For instance, when a combination of $d_1$ and $d_2$ in Table 1 is made double (i.e., $d_1$, $d_2$, $d_1'$ and $d_2'$), the number of voltage levels required is 10 levels, and 11 gradation levels can be displayed in a single display frame. In this case, the number of gradation levels can rapidly be increased as the number of frames is increased. For instance, a display of more than 64 gradation levels can be displayed by using the FRC method for 2 frames.

Further, in the gradation display in combination of the FRC method using many frames, it is effective to increase gradation levels by changing row voltages in correspondence to the frames. In the conventional technique, because a gradation display is conducted by using only the FRC method wherein signal modulation was carried out by changing row voltages, it was necessary to change substantially the row voltages in order to increase the number of gradation levels (Japanese Unexamined Patent Publication No. 230752/1994). In the conventional technique, accordingly, there were such problems that there caused a shift in bias ratio (the ratio of column voltage to row voltage); the voltage ratio of ON/OFF became small and the contrast ratio and brightness were reduced. On the other hand, in the present invention, since an increase of the gradation levels due to the amplitude modulation has already been obtained in a single frame, it is easy to further increase the gradation levels by chaining slightly the row voltages. Accordingly, the number of gradation levels can be increased without a substantial influence to the ON/OFF voltage ratio to be applied to liquid crystal. More specifically, the conventional technique required voltage modulation of more than 100% (more than 1:2 in the row voltage ratio) among a plurality of frames, for instance. On the other hand, the present invention permits an increase of gradation levels by a voltage modulation of less than 50%, usually less than 30%. In this case, there is no substantial effect to the ON/OFF voltage ratio.

Application of the present invention to multiple line selection method

Description will be made as to the application of the present invention to a multiple line selection method (including an active addressing/(AA) method) which has attracted attention recently.

In the multiple line selection method, the number of voltage levels required for display is larger than that in the conventional driving method even when the gradation display is unnecessary. Generally, when an L number of lines are simultaneously selected, an (L+1) number of voltage levels is required.

It is especially desirable to satisfy the following two conditions in order to apply the AM method to the multiple line selection method:

1) to reduce the number of levels required in the AM method itself as possible, and
2) to arrange the levels used at equal intervals.

With the satisfaction of the condition 1), there is obtainable substantial improvement with respect to the reduction of the number of voltage levels in comparison with the conventional method. The reason that the condition 2) should be satisfied in addition to the condition 1) is as follows.

In the multiple line selection method, since column voltages are in proportion to values obtained by matrix calculation with use of an orthogonal function of display data on the simultaneously selected lines, many additions and subtractions are conducted between voltage levels. In this case, if the voltage levels are not arranged at equal intervals, it is necessary to form a new level or levels according to the respective calculations. When the number of L is large, the number of required levels is exponentially increased. From this viewpoint, use of the display data $d_1=\pm 0.8$ and $d_2=\pm 0.6$, as intermediate gradation levels, is suited for the multiple line selection method.

With respect to this, explanation will be made as to a case that 1, 0.8, 0.6, 0, −0.6, −0.8 and −1 are used as display data for the AM method. In this case, in the same manner as successive line selection method, 6 kinds of data, i.e., ±1, ±1.4 and ±0.2 are required as divided data X and Y. In the multiple line selection method, column voltages are determined by additions and substations of these divided data. In this example, since it can be considered that a part of voltage levels having intervals of 0.4 is used, the voltage levels obtained by the additions and subtractions also have values having intervals of 0.4. Further, the maximum voltage level is 1.4.L. Accordingly, a (1.4.L/0.4)×2 number of voltage levels is needed in this case. On the other hand, if the original voltage levels do not use a part of the levels of equal intervals, the number of required column voltage levels is exponentially increased with respect to the number of simultaneously selected lines.

According to one embodiment of the present invention, the number of voltage levels is not exponentially increase even when a gradation display is conducted by the AM method in combination of the multiple line selection method. For instance, when L=3, the number of levels necessary for a 7 gradation display in the AM method is only 21. In comparison with the conventional technique, the number of levels is reduced to 1/20 or lower. Namely, in the conventional technique, error in a display was unavoidable even with use of drivers of 8 bits, whereas in the present invention, use of drivers of 5 bits can provide a display free from error.

Table 6 shows an example of values of column voltage levels $V_x$ and $V_y$ resulted in combination of various data when three lines are simultaneously selected (L=3), Table 6 shows voltage levels necessary when row selection patterns is (1,1,1) or (−1, −1, −1). All necessary voltage levels with respect to the all selection patterns are shown. In this example, the divided data produced by using the AM method are divided into a group of ±1.4 and ±1 and a group of ±1 and ±0.2, and each of the groups is put in each of the subframes X, Y. Namely, according to the expression in Table 3, $X_0=1.4$ and $Y_0=0.2$. Thus, an increase in voltage levels due to the additions and subtractions can be prevented when the divided data are distributed to the subframes so that data having the same absolute values are combined in a subframe, whereby the number of the divided data having different absolute values is reduced.

TABLE 6

| Combination of data (X) | Voltage level $V_X$ | Combination of data (Y) | Voltage level $V_Y$ |
|---|---|---|---|
| 1.4, 1.4, 1.4 | ±4.2 | 1.0, 1.0, 1.0 | ±3.0 |
| 1.4, 1.4, 1.0 | ±3.8 | 1.0, 1.0, 0.2 | ±2.2 |
| 1.4, 1.0, 1.0 | ±3.4 | 1.0, 1.0, −0.2 | ±1.8 |

TABLE 6-continued

| Combination of data (X) | Voltage level $V_X$ | Combination of data (Y) | Voltage level $V_Y$ |
|---|---|---|---|
| 1.0, 1.0, 1.0 | ±3.0 | 1.0, 0.2, 0.2 | ±1.4 |
| 1.4, 1.4, −1.0 | ±1.8 | 1.0, 1.0, −1.0 | ±1.0 |
| 1.4, 1.0, −1.0 | ±1.4 | 1.0, 0.2, −0.2 | ±1.0 |
| 1.4, 1.4, −1.4 | ±1.4 | 0.2, 0.2, 0.2 | ±0.6 |
| 1.0, 1.0, −1.0 | ±1.0 | 1.0, −0.2, −0.2 | ±0.6 |
| 1.0, 1.4, −1.4 | ±1.0 | 0.2, 0.2, −0.2 | ±2.0 |
| 1.0, 1.0, −1.4 | ±0.6 | 1.0, −1.0, 0.2 | ±2.0 |

A suitable range of L is not determined by only the number of voltage levels, but determined by an effect of controlling frame response, i.e. in consideration of the contrast ratio. The control of frame response is related to the number of all lines, a driving frequency, a response time of liquid crystal and so on. For instance, when the number of all lines N is 200–400; liquid crystal has a response time (the average between rising time and falling time) of 150 ms or lower, and the width of the selection pulses is 20–50 $\mu$s, it is preferable that $2 \leqq L \leqq 15$ from the viewpoint of satisfying performance of manufacturing cost. Generally, as N is increased, the response time is faster, and the width of pulses is longer, a large L is desirable.

When the AM method is used, it is preferable to use a smaller value of L from the viewpoint of the number of levels as described above, as far as the frame response is reduced. Accordingly, the following conditions are preferably provided.

1) When $N \leqq 300$, $2 \leqq L \leqq 7$ and 2) when $N > 300$, $2 \leqq L \leqq 15$.

Condition 1) is applicable to dual scan driving of the dot numbers of (H640(×RGB)×V480), (H800(×RGB)×600) or the like, or single scan driving of a size of ½ or ¼ of the dot numbers of (N=240, 300). Condition 2) is applicable to driving a picture having heavy multiplexity, for instance, (H1024×768).

Depending on the condition of the number of simultaneously selected rows L, there are two desirable cases: application of the divided data X and Y to respective subframes, and both the divided data being used in each of the subframes. When L is large (in particular L>4), the first case is preferred. However, when L is small, either case may be used.

Table 6a shows an example of a combination of divided data as well as voltage levels when L=2 and divided data X, Y are distributed to respective subframes. Table 6b shows an example of a combination of divided data as well as voltage levels when L=2 and divided data X, Y are used in the same subframe and the same subgroup (i.e. X data is made correspondence to a single row line among simultaneously selected rows and Y data is made correspondence to another row line). In the Tables, ±1.4 and ±0.2 are used as divided data X, Y.

TABLE 6(a)

| Combination of data (X) | Voltage level $V_X$ | Combination of data (Y) | Voltage level $V_Y$ |
|---|---|---|---|
| 1.4, 1.4 | ±2.8 | 1.0, 1.0 | ±2.0 |
| 1.4, 1.0 | ±2.4 | 1.0, 0.2 | ±1.2 |
| 1.0, 1.0 | ±2.0 | 1.0, −0.2 | ±0.8 |
| 1.4, −1.0 | ±0.4 | 0.2, 0.2 | ±0.4 |
| 1.4, −1.4 | 0 | 1.0, −1.0 | 0 |
| 1.0, −1.0 | 0 | 0.2, −0.2 | 0 |

TABLE 6(b)

| Combination of data (X,Y) | Voltage level $V_X$ |
|---|---|
| 1.0, 1.0 | ±2.0 |
| 1.4, 0.2 | ±1.6 |
| 1.4, −0.2 | ±1.2 |
| 1.0, 0.2 | ±1.2 |
| 1.0, −0.2 | ±0.8 |
| 1.0, −1.0 | 0 |

As shown in Table 6(a) and 6(b), when the data X, Y are simultaneously made in correspondence to lines in the same subgroup (Table 6(b)), the maximum voltage level is more reduced and at the same time, the total level number is more reduced. In this case, there are advantages that the maximum voltage of drivers can be reduced and ununiformity (crosstalk) in a display due to a waveform distortion can be be reduced. Accordingly, it is advantageous that X and Y divided data are used in the same subgroup of the same subframe when L=2. The above-mentioned relation is effective in particular when L is small and has an even number. For instance, in a case of L=2 or 4, and when X data are applied to a half portion of simultaneously selected line and Y data are applied to the remaining half portion, there are advantageous from the viewpoint of the quality of display and the reduction of manufacturing cost.

Figure 4:
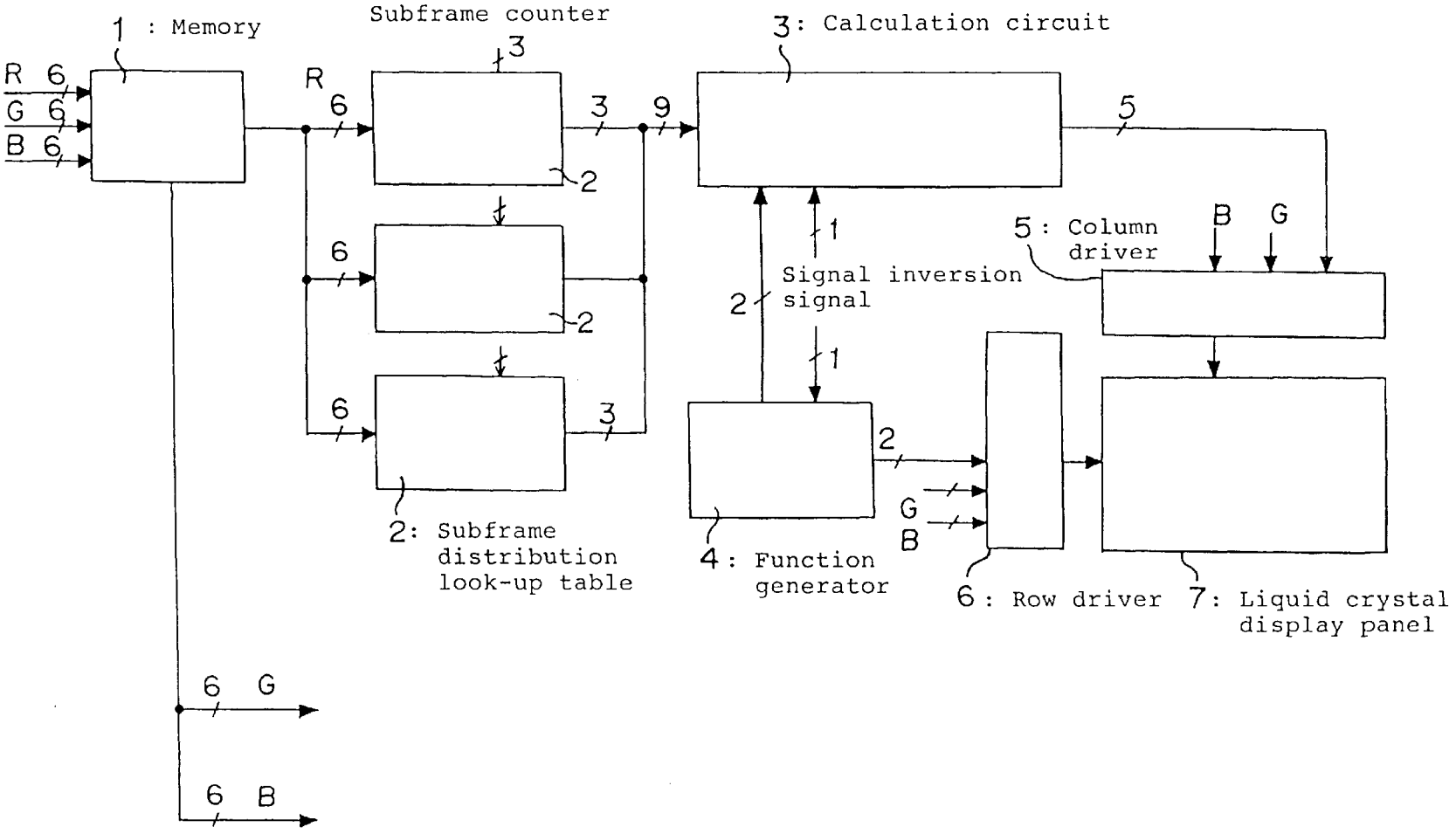
FIG. 4 is a block diagram of a circuit used for a multiple line selection method on the present invention.

FIG. 4 is a block diagram of an embodiment of circuit for driving a liquid crystal display device according to the multiple line selection method. 6 bit digital RGB signals are stored in a memory 1 in an amount corresponding to a single picture. Then, the digital signals are read out and are distributed, for each simultaneously selected line, to three subframe-distribution look-up tables 2 in which the signals are subjected to γ correction and frame distribution for frame rate control.

The frame-distributed signals output, in synchronism with subframe counters, display data for each subframe in a 3-bit parallel form. The display data are supplied to a calculation circuit 3. The signals calculated in the circuit 3 are fed to column drivers 5 to be converted into column voltages, and then, the column voltages are applied to a liquid crystal display panel 7.

The calculation circuit 3 receives an orthogonal function for calculation from a function generator 4. The orthogonal function is also supplied to row drivers 6 to be converted into row voltages, and then, the row voltages are applied to the liquid crystal display panel 7. Inversion signals are applied to the calculation circuit 3 and the function generator 4 at predetermined timing to effect the inversion of signs whereby a direct current component to be applied to liquid crystal is removed.

Reduction of the number of voltage levels by the determination of an imaginary (dummy) row and imaginary (dummy) data The present invention proposes that a plurality of row electrodes are simultaneously selected; an imaginary row electrode is added to the simultaneously selected row electrodes, and data are determined on the imaginary row electrode whereby the number of voltage levels to be applied to data electrodes is reduced.

In one embodiment of the present invention, since gradation driving is effected by using the AM method, display data are composed of two or more kinds of data having different absolute values. In the following, description will be made as to conditions for reducing the number of voltage levels.

In one of the conditions, the display data corresponding to the simultaneously selected row electrodes (which include at least one imaginary electrode) are divided into plural groups of display data having different absolute values, and data are determined on the imaginary row electrode so that the number of display data included in each of the groups takes a predetermined discrete integer value.

Examples of the discrete integer values are as follows: (1, 3, 5, 7, . . . ), (2, 4, 6, 8, . . . ), or (3, 6, 9, 12, . . . ).

In particularly, it is preferable that the number of the display data having the same absolute values in a subgroup including dummy line be unified to be an even number or an odd number in order to prevent the number of the imaginary electrodes becoming too much.

The above-mentioned conditions will be explained with reference to a drawing.

Figure 2:
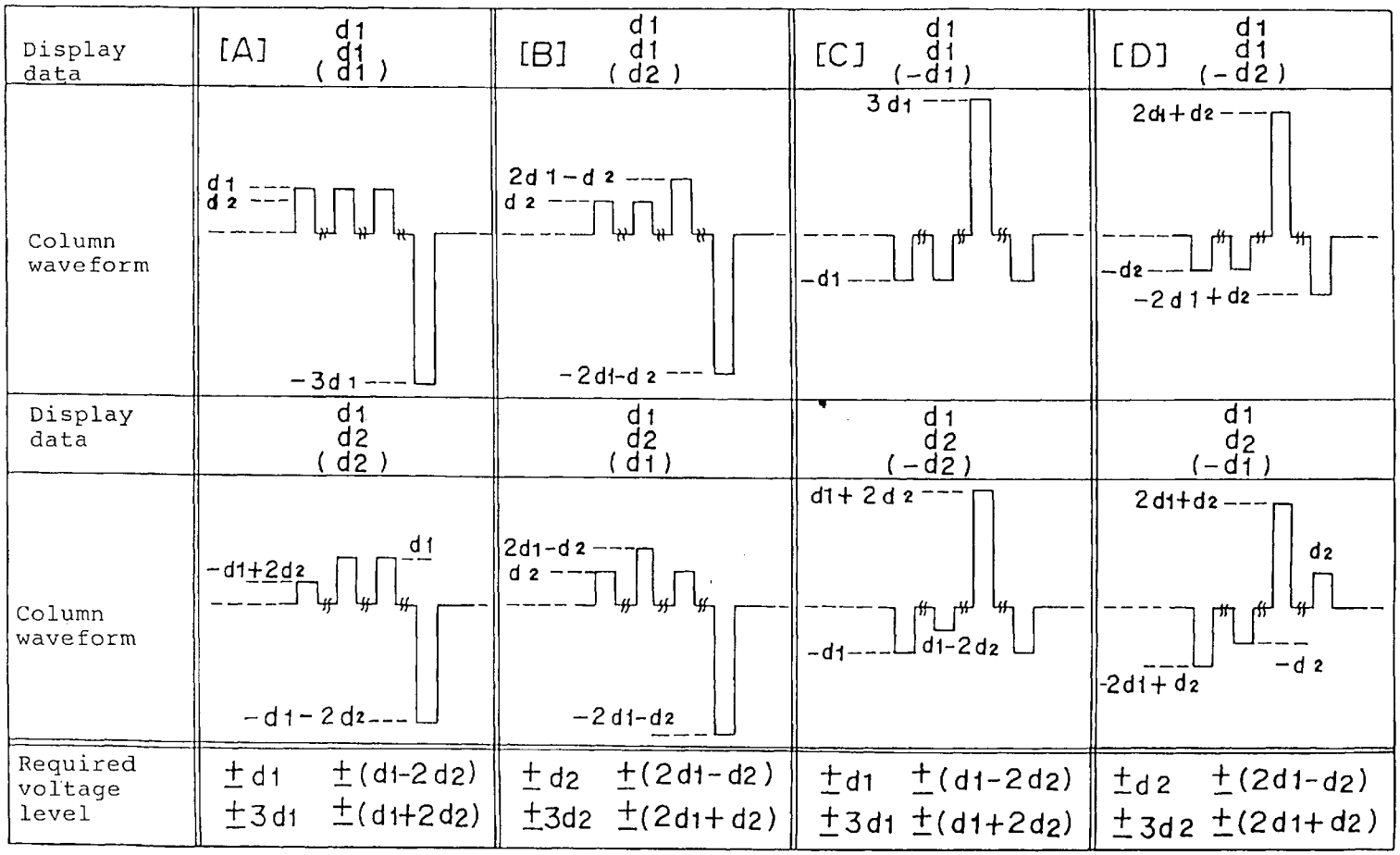
FIG. 2 is a diagram showing the effect of reducing voltage levels in a case that a driving method for selecting simultaneously two lines is used and a single line of imaginary electrode is added.

FIG. 2 shows the effect of reducing voltage levels in a case that a single line of imaginary electrode is added in a driving method for selecting simultaneously two lines of row electrodes. In FIG. 2, there are four laterally arranged columns (A) to (D), each column including two cases. Explanation of each of the columns is as follows.

The column A shows a case that the number of data $d_1$ is unified to have an odd number, and the number of data $d_2$ is unified to be an even number. The column B shows a case that the number of data $d_1$ is unified to be an even number, and the number of data $d_2$ is unified to be an odd number. The column C shows a case that the number of data $d_1$ is unified to be an odd number and the number of data $d_2$ is unified to be an even number in the same manner as the column A, wherein, the product of data vector elements has a negative sign. The column D shows a case that the number of data $d_1$ is unified to be an even number, and the number of data $d_2$ is unified to be an odd number wherein the product of data vector elements has a negative sign.

Among the display data in FIG. 2, data in brackets indicate imaginary data, and a waveform drawn below each of data columns is one obtained by the data including the imaginary data. In lower columns, voltage levels required to display all actual display patterns are shown in consideration of the necessity of voltage levels having the opposite signs in order to form an alternate current. The selection matrix shown in Table 7 is used wherein two lines are actually existing display lines are one line is an imaginary line. Further, columns in the matrix correspond to the time sequence of selection pulses.

TABLE 7

$$\begin{bmatrix} -1 & 1 & 1 & -1 \\ 1 & -1 & 1 & -1 \\ 1 & 1 & -1 & -1 \end{bmatrix}$$

As shown in FIG. 2, the voltage levels required for two cases in which the number of data $d_1$ and the number of data $d_2$ are opposite with respect of an even number or an odd number are respectively 8 levels. When three row electrodes are simultaneously selected, and two kinds of data having different absolute values are treated, 16 levels are naturally required. In the case shown in FIG. 2, 16 levels are divided to two cases. This can be considered that there is no level necessarily taken since the number of respective data with respect to an even number or an odd number is already determined. Conventionally, when two row electrodes are simultaneously selected, and two kinds of data having different absolute values are treated, 9 levels are required. However, when the imaginary row electrode is provided, and suitable imaginary data are selected as proposed by the present invention, it is understood that voltage levels are reduced by 1 level.

Generally, when the number of display data is so determined as to have a predetermined discrete integer value, a similar effect is obtainable. However, when the number of display data is fixed to be a multiple of 3, the number of required imaginary electrodes is increased and the contrast ratio is reduced. Accordingly, it is preferable that the number of display data is fixed to have an even number or an odd number.

Another condition to reduce the number of voltage levels is that a selection matrix in which the sign of the product of column vector elements is constant, is used, and data are determined on the imaginary row electrode so that the sign of the product of display data elements corresponding to simultaneously selected row electrodes (including an imaginary row electrode) is constant. In particular, it is preferable that the sign of the product of the display data elements is opposite to the sign of the product of the column vector elements of the selection matrix whereby the maximum voltage level can be reduced.

This condition exhibits a substantial effect to reduce the number of voltage levels when the number of simultaneously selected row electrodes including at least one imaginary row electrode is of an even number. In specific example concerning this condition will be explained with reference to FIG. 3.

Figure 3:
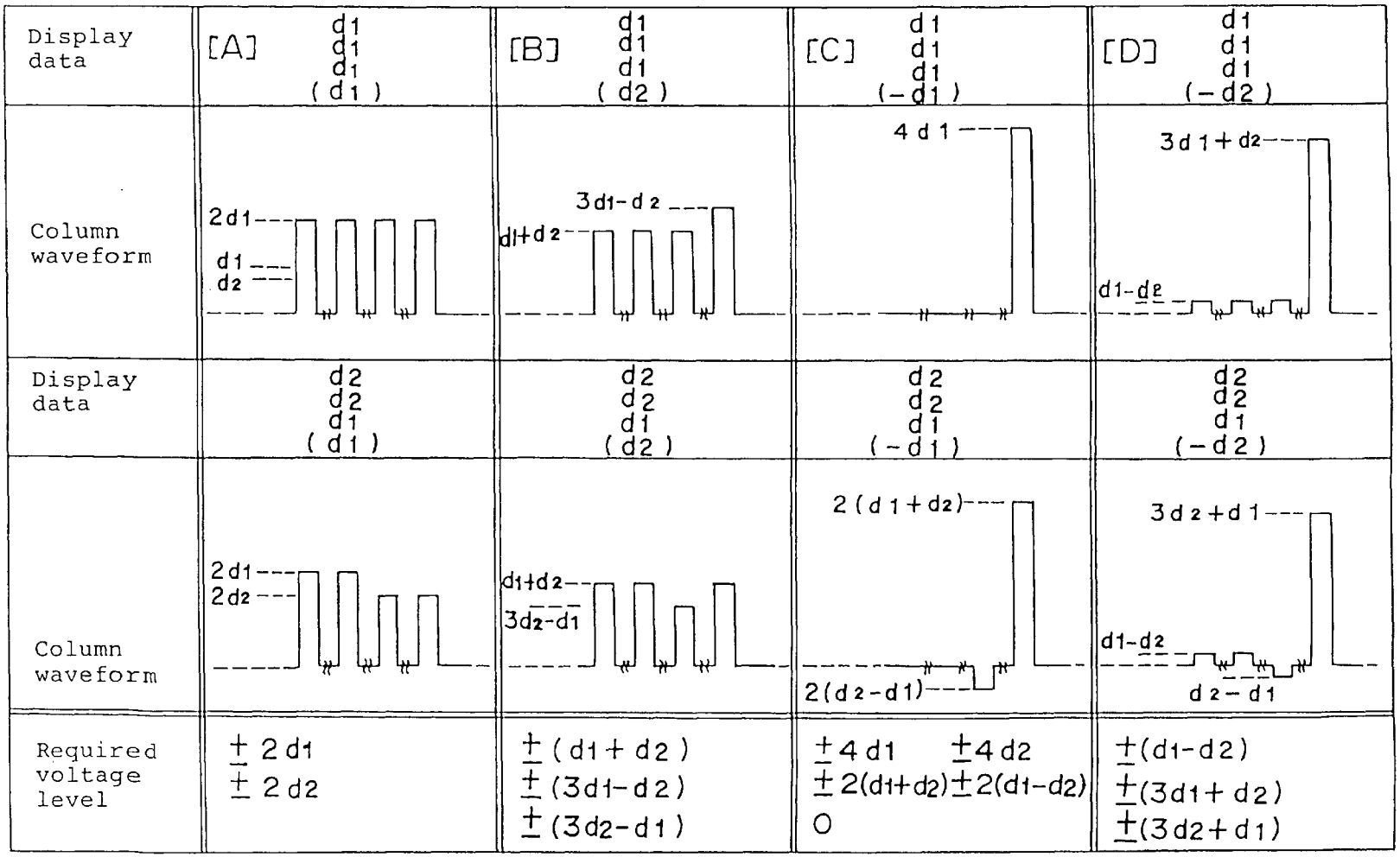
FIG. 3 is a diagram showing the effect of reducing voltage levels in a case that a driving method for selecting simultaneously three lines is used and a single line of imaginary electrode is added.

FIG. 3 shows the effect of reducing voltage levels in a case that a single line of imaginary electrode is added in a driving method for selecting simultaneously three lines. Bracketed data in columns of display data indicate imaginary data, and waveforms are ones obtained in this case. In the same manner as FIG. 2, voltage levels necessary for displaying all actual display patterns are shown in the lowermost columns. The selection matrix shown in Table 8 is used wherein three lines indicate actually existing display lines, and a single line corresponds to an imaginary line. Columns in the matrix correspond to the time sequence of selection pulses. In this matrix, the sign of the product of the column vector elements is constantly negative. For example, although the matrix formed by inversing the sign of the column of right end side in the matrix shown in Table 7 is also an orthogonal matrix, such matrix does not show that the sign of the product of column vector elements is constant.

TABLE 8

$$\begin{bmatrix} -1 & 1 & 1 & 1 \\ 1 & -1 & 1 & 1 \\ 1 & 1 & -1 & 1 \\ 1 & 1 & 1 & -1 \end{bmatrix}$$

In a case shown in a column A, the number of each data $d_1$ or $d_2$ is unified to be an even number, and the sign of the product of display data elements is unified to be opposite to the sign of the product of column vector elements in the selection matrix. In a case shown in a column B, the number of each data $d_1$ or $d_2$ is unified to be an odd number, and the sign of the product of the display data elements is unified to be opposite to the sign of the product of the column vector elements in the selection matrix.

In the case shown in a column C, the number of each data $d_1$ or $d_2$ is unified to be an even number, and the sign of the product of the display data elements is unified to be the same as the sign of the product of the column vector elements in the selection matrix. In the case shown in a column D, the number of data $d_1$ or $d_2$ is unified to be an even number, and the sign of the product of the display data elements is unified to be the same as the sign of the product of the column vector elements in the selection matrix.

As shown in FIG. 3, the numbers of voltage levels required to the above-mentioned cases are 4, 6, 9 and 6. When 4 row electrodes are simultaneously selected and 2 kinds of data having different absolute values are treated, 25 levels are originally needed. As understood from FIG. 3, 25 levels are divided to the above-mentioned 4 cases. The reason that 25 levels are divided to the 4 cases is because there are levels which are not necessarily taken since an even number or an odd number is already determined as to the number of respective data. Further, the polarity inversion of data to form an alternate current waveform does not increase the number of voltage levels since each of the cases has voltage levels which are symmetrical with respect to a positive or negative sign. The advantage that the number of voltage levels is not increased even though the polarity inversion is conducted for an alternate current form, is obtainable when the number of simultaneously selected rows including an imaginary row or rows is of an even number.

Further, in FIG. 3, when the sign of the product of display data elements is opposite to the sign of the product of column vector elements in the selection matrix, it is understood that the maximum voltage level is decreased. It is because that there is no coincidence of the signs of all the display data at the time of additions and subtractions in the operation of orthogonal transformation. Use of an orthogonal matrix as a selection matrix in which the sign of the product of column vector elements is not constant, is disadvantageous in this respect.

As understood from FIG. 3, a case that a single line of imaginary electrode is added in a driving method for simultaneously selecting 3 lines, provides the most preferable advantage under the conditions that the numbers of data $d_1$ and $d_2$ are unified to be even numbers respectively, and the sign of the product of display data elements is unified so as to be opposite to the sign of the product of column vector elements in the selection matrix. Namely, the most desirable conditions from the viewpoints of reducing the number of voltage levels and reducing the maximum voltage levels are such that (1) the number of all simultaneously selected lines including an imaginary electrode or electrodes is of an even number, (2) the number of each data is unified to be an even number, and (3) the sign of the product of display data elements is unified so as to be opposite to the sign of the product of column vector elements in the selection matrix.

With respect to the number of simultaneously selected row electrodes (L) in the present invention, a range of about $2 \leqq L \leqq 16$ is desirable from the viewpoint of simplifying the structure of circuits and controlling the frame response. However, it is desirable that an orthogonal function for determining a series of selection pulses has a nearly square matrix so as not to increase the length of frames for completing a display from the viewpoint of controlling a flicker or the like. In consideration of this, $L=2^S-1$ is most desirable, hence, a desirable L is 3, 7 or 15. In particular, L=3 or 7 is preferable, in particular, L=3 is most preferable from the viewpoint of the construction of circuits and drivers used.

As described before, when $d_1$ and $d_2$ $(=(1-d_1^2)^{0.5})$ are used as gradation data, levels corresponding to APT (one line selection) are basically 6 kinds: ±1, $\pm X_0$ and $\pm Y_0$. Accordingly, when a line of imaginary electrode is added in the driving method for simultaneously selecting 3 lines, conditions capable of substantially reducing the number of voltage levels are to satisfy the following items 1) to 3). However, the item 1) is not essential.

1) There are two subframes for a specified subgroup: an X subframe to which only ±1 and $\pm X_0$ are distributed, and an Y subframe to which only ±1 and $\pm Y_0$ are distributed;

2) The sign of the product of display data elements is unified to be opposite to the sign of the product of column vector elements in the selection matrix, and 3) The number of "±1", "$\pm X_0$", "$\pm Y_0$" in the data on 4 lines should take an even number.

In the satisfaction of these conditions, the number of voltage levels can be reduced to the lowest value. For instance, when L=3, the number of levels required is 6 levels (±2, $\pm 2X_0$ and $\pm 2Y_0$). This is lower than ⅓ in comparison with 21 levels without using imaginary data. Accordingly, the number of data bits used inside is reduced from 5 bits to 3 bits, which permits use of an economical column driver.

The sign of the product of column vector elements in the selection matrix can be determined from the way how the selection matrix is formed from an Hadamard's matrix. Namely, when the selection matrix is formed by using an Hadamard's matrix by exchanging a row or rows or a column or columns, and/or inverting the polarity of a row or rows or a column or columns, the sign is determined depending on the number of inversion of the row, rows, column and columns as to whether or not the inversion is conducted even times or odd times. When the number of turns of inversion is an even number, the number of a negative sign in the data on 4 lines is rendered to be an odd number. When the number of turns of inversion is an add number, the number of a negative sign in data on 4 lines is rendered to be an even number.

Description will be made by using a 4×4 matrix in Table 8 as an example. This matrix can be obtained by treating an Hadamard's matrix as follows:

1) the second and third columns are inversed;

2) the second and third rows are exchanged, and 3) the first row is unversed.

In this case, the number of negative signs in the data on 4 lines is rendered to be an even number since the row is inverted once.

Another major advantage of the present invention is to reduce the maximum value of column voltage. A concrete explanation will be made as to a case of $d_1=0.8$ and $d_2=0.6$. For instance, when L=3 and data values are all 1.4 for the selection pulses (1, 1, 1), the column voltage level becomes 1.4×3=4.2. On the other hand, according to the present invention, the maximum value of column voltage is 1.4×2=2.8, which is half as in the conventional technique.

The reduction of the maximum column voltage provides not only an improvement in low power consumption rate but also suppressing a large variation of the column voltage waveform to be applied. Namely, a crosstalk caused by a distortion of the waveform of voltages due to a sudden change of the voltage (i.e., high frequency components) can be reduced.

The advantages of the present invention can be summarized as follows:

1) the number of column voltage levels can be reduced;

2) the absolute value of column voltages can be reduced; and 3) crosstalking can be reduced.

Thus, advantages of reducing manufacturing cost and improving the quality of display are simultaneously obtainable.

There is a disadvantage in the driving method wherein an imaginary line is added because the imaginary line is added in originally simultaneously selected lines. The disadvantage is derived from a change of duty ratio which is caused by the fact as if there are (L+1) lines even though only L lines are actually driven simultaneously. Specifically, the addition of an imaginary line to an L number of simultaneously driven lines in an N number of lines means that an N/L×(L+1) number of lines are driven.

For instance, a case of N=240 corresponds to driving 320 lines wherein the number of simultaneously selected actual lines is 3, and an imaginary electrode is added. Further, a case of N=240 corresponds to driving 280 lines wherein the number of simultaneously selected actual lines is 7, and an imaginary electrode is added. In the above-mentioned cases, the ON/OFF ratio of effective voltages are respectively 1.057 and 1.062 in comparison with 1.066 in the conventional driving method.

A circuit used in a case that a dummy line is used to reduce the number of voltage levels is substantially the same as the circuit shown in FIG. 4, wherein the calculation circuit 3 corresponds to a dummy data generation and matrix calculation look-up table having a 3 bit output.

6 bit digital LGB signals for displaying a picture are stored in a memory 1. The signals in the memory 1 are read out and supplied to three subframe distribution look-up tables 2 for each simultaneously selected lines. The signals are subjected to γ correction and frame distribution for receiving frame rate control. The frame-distributed signals output, in synchronism with subframe counters, display data, as a 3 bit parallel signal form for each subframe. The outputted display data signals are supplied to a dummy data generation and matrix calculation look-up table (3) in which calculation is made on the display data including dummy data. The calculated signals are supplied to column drivers 5 in which the signals are transformed into column voltages to be applied to a liquid crystal display panel 7.

An orthogonal function is supplied for calculation from a function generator 4 to the dummy data generation and matrix calculation look-up table (3). The orthogonal function is also supplied to row drivers 6 in which data are transformed into row voltages to be applied to the liquid crystal display 7. Sign-inversion signals are supplied to at a predetermined timing to the dummy data generation and matrix calculation look-up table (3) and the function generator 4 in which operations of inverting the signs are conducted and a direct current component applied to liquid crystal is removed.

Reduction of ununiformity of display

When intermediate tones are displayed by the techniques which have been explained, a phenomenon of inversion of brightness may occur unlike the original gradation levels to be displayed, depending on display patterns because the waveforms of column voltages have different spectrum distributions at the time of displaying gradation data. Namely, the gradation (brightness) levels to be displayed depend on the magnitude of the effective voltages as well as the frequency characteristic of column voltages applied to a display panel. As the number of gradation levels is increased, the difference of the effective voltages between adjoining gradation levels is slight. When the frequency characteristics of column voltage are different, there is a possibility of occurrence of a phenomenon of inversion of brightness between gradation levels.

One embodiment of the present invention is to solve such problem and provides a further excellent display, and proposes that in displaying intermediate gradation data, signals which are applied to column voltages in response to selection pulses in a time period wherein all row electrodes are applied with at least one selection pulse hereinbelow, (referred to as a scanning time) include in a mixed state at least one signal which is obtained by the orthogonal transformation of a data element having the absolute value exceeding 1 among divided gradation data and at least one signal which is obtained by the orthogonal transformation of a data element having the absolute value less than 1. With such measures, such a disadvantage that frequency components of driving signals are low in a specified gradation level can be avoided, and the phenomenon of inversion of gradation as described above can be suppressed.

As mentioned before, when certain gradation data are displayed by using the X subframe and Y subframe, gradation data having the absolute value exceeding 1 correspond to $\pm X_0$ where $(X_0=d_1+(1-d_1^2)^{0.5})$ expressed in the x subframe, and gradation data having the absolute value less than 1 correspond to $\pm Y_0$ where $(Y_0=d_1+(1-d_1^2)^{0.5})$ expressed in the Y subframe.

Namely, the above-mentioned technique can be said that there are in a mixed state column voltage levels based on divided data X and column voltage levels based on divided data Y in a scanning time. With such technique, the waveform of column voltages is made in a high frequency form as a whole, and the waveform of column voltages between respective gradation levels is made uniform in terms of frequency.

As described before, in the gradation display using the AM method according to the present invention, the effective voltage values to non-selection pixels are not constant and rely on the display data under a condition that only the data of the X subframe have been finished, and the voltage effective values to the non-selection pixels become constant regardless of the display data only when the data in the X subframe and the Y subframe have been displayed. Accordingly, if a timing for switching pictures is inappropriate, the effective voltages are largely varied, and a change of brightness in pixels is produced with a time scale to the extent visible to human eyes, whereby it is observed as a vertical stripe-like ununiform portion. Such phenomenon is notable when dynamic pictures are displayed.

The present invention proposes a method for reducing such vertical stripe-like ununiform portion. Namely, when signals are applied to column electrodes with respect to a simultaneously selected row electrode group, the signal are formed by the orthogonal transformation of all the divided gradation data necessary for displaying a predetermined gradation data, and the signals are successively applied, as a group for each of column vectors of a selection matrix, to the column electrodes in response to a timing of the application of selection pulses.

When all signals based on the divided gradation data orthogonally transformed by a series of column vectors in the selection matrix have been applied, the voltage effective values applied to non-selection pixels exhibit a constant value regardless of the display data. Accordingly, use of the above-mentioned technique can shorter the the time period in which the voltage effective values applied to the non-selection pixels are constant regardless of the display data, and the occurrence of the vertical stripe-like ununiform portion can be effectively reduced.

In the above-mentioned case that certain gradation data are displayed by using the X subframe and the Y subframe, signals based on divided data X and signals based on divided data Y, which are orthogonally transformed by the same column vectors in a selection matrix, are successively applied, in response to a timing of applying selection pulses, to a specified group of a simultaneously selected row electrodes. When the signals based on the divided data X and the signals based on the divided data Y, both having been subjected to orthogonal transformation, have been applied to column voltages, the voltage effective values applied to non-selection pixels become constant regardless of the display data.

In order to explain the above-two proposals in more detail, description will be made as to selection pulse sequence in a case that a gradation display is conducted by using the AM method in the present invention, in a multiple line selection method.

The relation between column electrode display pattern vectors (D) and column electrode voltage sequence vectors (c) in the multiple line selection method without using the AM method can be described as a general expression consisting of vectors and matrix as in Formula 7.

$$(c) = (D)(S) \quad \text{[Formula 7]}$$
$$\text{where } (c) = (c_1, c_2, \cdots, c_N)$$
$$(D) = (D_1, D_2, \cdots, D_M)$$

(D): display pattern vectors, (c): column voltage sequence vectors, and (S): row electrode pulse sequence matrix.

In Formula 7, the vectors (D), the vectors (c) and the matrix (S) are defined as follows. The display pattern vectors $(D)=(D_1, D_2, \ldots, D_M)$ have elements equal to the number of row electrodes M (including an imaginary electrode or electrodes, an imaginary subgroup or subgroups) and have display data as elements corresponding to the row electrodes on a specified column electrode. In the same manner as described before, it is supposed that OFF indicates 1 and ON indicates −1. The column voltage sequence vectors $(c)=(c_1, c_2, \ldots, c_N)$ have elements equal to the number of pulses N applied within a frame, and have elements obtained by arranging time sequentially voltage levels to a specified column voltage in a frame.

The row electrode pulse sequence matrix (S) is a matrix of M rows and N columns and have elements obtained by arranging time sequentially column vectors composed of row electrode voltage levels with respect to a specified column electrode in a frame. Elements corresponding to non-selection row electrodes are made 0. The row electrode pulse sequence matrix (S) as a typical matrix can be described as in Formula 8 wherein $A_i$ indicates a column vector of the i th column in a selection matrix A and $Z_e$ indicate a 0 vector.

$$(S) = \begin{bmatrix} A_1 & Z_e & Z_e & \cdots & Z_e & A_2 & Z_e & \cdots & Z_e & A_3 & Z_e & \cdots & Z_e & \cdots & A_k & Z_e & \cdots & Z_e \\ Z_e & A_2 & Z_e & \cdots & Z_e & Z_e & A_3 & \cdots & Z_e & Z_e & A_4 & \cdots & Z_e & \cdots & Z_e & A_1 & \cdots & Z_e \\ Z_e & Z_e & A_3 & \cdots & Z_e & Z_e & Z_e & \cdots & Z_e & Z_e & Z_e & \cdots & Z_e & \cdots & Z_e & Z_e & \cdots & Z_e \\ \vdots & \vdots & \vdots & & \vdots & \vdots & \vdots & & \vdots & \vdots & \vdots & & \vdots & & \vdots & \vdots & & \vdots \\ Z_e & Z_e & Z_e & \cdots & A_p & Z_e & Z_e & \cdots & A_q & Z_e & Z_e & \cdots & A_r & \cdots & Z_e & Z_e & \cdots & A_{p-1} \end{bmatrix} \quad \text{[Formula 8]}$$

According to the principle of the multiple line selection method, the exchange of column vectors in the row electrode pulse sequence matrix (S) can be made as desired. Accordingly, if a specific relation between the number of row electrode subgroups Ns and the number of column vectors K in the selection matrix A can be satisfied, column vectors in the row electrode pulse sequence matrix (S) can be exchanged without causing the jumping of column vectors in the selection matrix A wherein the jumping of column vectors may be caused in a case when a subgroup 1 is selected after a subgroup Ns has been selected.

As an example, when the number of simultaneously selected row electrodes (including an imaginary electrode) is 4 and the number of column vectors in the selection matrix A is 4, and if the number of subgroups is determined to be 81, there is avoidable jumping of column vectors in the selection matrix when selection moves from a subgroup 80 to a subgroup 1 as shown in Formula 9. Since the elimination of the jumping minimizes an undesired low frequency component, the occurrence of a flicker can be controlled in many cases. When the number of subgroups does not coincide with an actually used panel, the jumping of column vectors in the selection matrix can be eliminated by providing a dummy subgroup.

$$(S) = \begin{bmatrix} A_1 & Z_e & Z_e & \cdots & Z_e & A_2 & Z_e & \cdots & Z_e & A_3 & Z_e & \cdots & Z_e & A_4 & Z_e & \cdots & Z_e \\ Z_e & A_2 & Z_e & \cdots & Z_e & Z_e & A_3 & \cdots & Z_e & Z_e & A_4 & \cdots & Z_e & Z_e & A_1 & \cdots & Z_e \\ Z_e & Z_e & A_3 & \cdots & Z_e & Z_e & Z_e & \cdots & Z_e & Z_e & Z_e & \cdots & Z_e & Z_e & Z_e & \cdots & Z_e \\ \vdots & \vdots & \vdots & & \vdots & \vdots & \vdots & & \vdots & \vdots & \vdots & & \vdots & \vdots & \vdots & & \vdots \\ Z_e & Z_e & Z_e & \cdots & A_1 & Z_e & Z_e & \cdots & A_2 & Z_e & Z_e & \cdots & A_3 & Z_e & Z_e & \cdots & A_4 \end{bmatrix} \quad \text{[Formula 9]}$$

In an AM method usable in the present invention, the voltage effective values to non-selection pixels can not be constant by using a single subframe, and at least two subframes are required. In such AM method applicable to the present invention, it is necessary to apply some modification to the above-mentioned Formula 7 in order to express the relation of the display pattern vectors (D) in a frame and the column voltage sequence vector (c). An example of a case that a single frame is expressed by using two subframes X, Y will be described. In this case, $(D_{X+Y})$, $(c_{X+Y})$ and $(S_{X+Y})$ are used in order to distinguish them from (D), (c) and (S) which are for the case without using the AM method. Then, Formula 10 is established in the same manner as Formula 7.

$$(c_{X+Y}) = (D_{X+Y})(S_{X+Y}) \quad \text{[Formula 10]}$$
$$\text{where } (c_{X+Y}) = (c_1, c_2, \cdots, c_{2N})$$
$$(D_{X+Y}) = (D_1, D_2, \cdots, D_{2M})$$

In Formula 10, $(D_{X+Y})=(D_1, D_2, \ldots, D_{2M})$ have elements twice as much as the number of row electrodes (including an imaginary electrode or a imaginary subgroup), and have divided data X and divided data Y, as elements, which corresponds to the row electrodes on a specified column electrode. In convenience of explanation, the first through the M th elements and the M+1 th through the 2M th elements of $(D_{X+Y})$ are supposed to be in correspondence to an M number of row electrodes on the specified row electrodes. Further, the column voltage sequence vectors $(c_{X+Y})=(c_1, c_2, \ldots, c_{2N})$ have elements twice as much as the number of pulses N applied to a subframe, and have elements which are formed by arranging time sequentially voltage levels corresponding to the specified column electrode in a frame. $(S_{X+Y})$ is typically expressed as shown in Formula 11 by using (S) in Formula 7 wherein Ze indicates a matrix composed of elements of 0.

$$(S_{X+Y}) = \begin{bmatrix} S & Z_e \\ Z_e & S \end{bmatrix} \quad \text{[Formula 11]}$$

Namely, the row electrode pulse sequence matrix $(S_{X+Y})$ is a matrix of 2M rows and 2N columns, and have elements formed by arranging time sequentially column vectors composed of row electrode voltage levels on a specified column electrode in a frame. The first through the M th elements and the M+1 th through the 2M th elements of $(S_{X+Y})$ correspond to row electrodes in a panel, the row electrodes being selected twice in a frame. Column vectors in $(S_{X+Y})$ correspond to elements formed by arranging time sequentially column vectors composed of row electrode voltage levels on the specified column electrode in a frame.

In the above-mentioned proposal, "signals obtained by the orthogonal transformation of data elements having the absolute value exceeding 1 among the divided gradation data and signals obtained by the orthogonal transformation of data elements having the absolute value less than 1 are included in a mixed state in signals applied to column electrodes in response to selection pulses in a scanning time" means that column electrode voltage sequence vectors $(C_{X+Y})$ are properly exchanged so that column voltage levels based on divided data X and column voltage levels based on divided data Y are mixed in the scanning time. In this case, the correspondent exchange of column vectors of $(S_{X+Y})$ are performed.

For instance, when divided gradation data of the X subframe which are orthogonally transformed with the j th column vectors of the selection matrix are applied as a signal to a specified column electrode at the time of selecting the i th simultaneously selected row subgroup, the signal is expressed as $g_{X^i_j}$. Similarly, when divided gradation data of the Y subframe which are orthogonally transformed with the j th column vectors of the selection matrix is applied as a signal to a specified column electrode at the time of selecting the i th simultaneously selected row subgroup, the signal is expressed as $g_{Y^i_j}$.

When a 4 row, 4 column selection matrix is used and column voltage levels based on divided data X are exchanged to column voltage levels based on divided data Y for every selection of 5 subgroups, column electrode voltage sequence vectors $(c_{X+Y})$ are expressed as shown in Formula 12, for example, where the number of subgroups is greater than 5.

$$\begin{aligned}(c_{X+Y}) = (&g_{X^1_1}\ g_{X^2_2}\ g_{X^3_3}\ g_{X^4_4}\ g_{X^5_1}\ g_{Y^6_2}\ g_{Y^7_3} \cdots \\ &g_{X^1_2}\ g_{X^2_3}\ g_{X^3_4}\ g_{X^4_1}\ g_{X^5_2}\ g_{Y^6_3}\ g_{Y^7_4} \cdots \\ &g_{X^1_3}\ g_{X^2_4}\ g_{X^3_1}\ g_{X^4_2}\ g_{X^5_3}\ g_{Y^6_4}\ g_{Y^7_1} \cdots \\ &g_{X^1_4}\ g_{X^2_1}\ g_{X^3_2}\ g_{X^4_3}\ g_{X^5_4}\ g_{Y^6_1}\ g_{Y^7_2} \cdots)\end{aligned} \quad \text{[Formula 12]}$$

A period for exchanging the data X and Y may be experimentally determined in consideration of a reduction of effective voltage due to a distortion of column voltage waveform.

"When signals are applied to the column electrodes with respect to a simultaneously selected row electrode group, the signals are formed by the orthogonal transformation of all the divided gradation data necessary for displaying a predetermined gradation data, and the signals are successively applied, as a group for each of column vectors of the selection matrix, to the column electrodes in response to a timing of the application of the selection pulses." This means that divided data X and divided data Y are exchanged for each selection pulse with respect to a specified simultaneously selected row electrodes. Specifically, this is a case of using the column electrode voltage sequence vectors $(c_{X+Y})$ as shown in Formula 13.

$$\begin{aligned}(c_{X+Y}) = (&g_{X^1_1}\ g_{X^2_2}\ g_{X^3_3}\ g_{X^4_4}\ g_{X^5_1}\ g_{Y^6_2}\ g_{Y^7_3} \cdots \\ &g_{Y^1_1}\ g_{Y^2_2}\ g_{Y^3_3}\ g_{Y^4_4}\ g_{Y^5_1}\ g_{X^6_2}\ g_{X^7_3} \cdots \\ &g_{X^1_2}\ g_{X^2_3}\ g_{X^3_4}\ g_{X^4_1}\ g_{X^5_2}\ g_{Y^6_3}\ g_{Y^7_4} \cdots \\ &g_{Y^1_2}\ g_{Y^2_3}\ g_{Y^3_4}\ g_{Y^4_1}\ g_{Y^5_2}\ g_{X^6_3}\ g_{X^7_4} \cdots \\ &g_{X^1_3}\ g_{X^2_4}\ g_{X^3_1}\ g_{X^4_2}\ g_{X^5_3}\ g_{Y^6_4}\ g_{Y^7_1} \cdots \\ &g_{Y^1_3}\ g_{Y^2_4}\ g_{Y^3_1}\ g_{Y^4_2}\ g_{Y^5_3}\ g_{X^6_4}\ g_{X^7_1} \cdots \\ &g_{X^1_4}\ g_{X^2_1}\ g_{X^3_2}\ g_{X^4_3}\ g_{X^5_4}\ g_{Y^6_1}\ g_{Y^7_2} \cdots \\ &g_{Y^1_4}\ g_{Y^2_1}\ g_{Y^3_2}\ g_{Y^4_3}\ g_{Y^5_4}\ g_{X^6_1}\ g_{X^7_2} \cdots)\end{aligned} \quad \text{[Formula 13]}$$

In Formula 13, column electrode levels based on divided data X and column voltage levels based on divided data X are exchanged each time of 5 selection pulses.

Formula 13 shows that when the first subgroup is firstly selected, the divided data X to the selection vector 1 is made correspondence to the first subgroup, and when the first subgroup is next selected (i.e. the second scanning), the divided data Y to the selection vector 1 is made correspondence to the first subgroup. Accordingly, when two times of scanning are finished, voltage effective values on a column electrode are constant with respect to any display pattern. This means that the voltage effective values on the column electrode are constant in a period of ¼ in comparison with a case that divided data X are made correspondence to four selection vectors in a subgroup, and then, divided data Y are made correspondence to four selection vectors in the same subgroup. Accordingly, in satisfaction of two conditions: divided data X and divided data Y for a subgroup are exchanged every selection pulses to the subgroup, and selection vectors used for selecting the subgroup are the same in the two scanning operations (in this case, the polarity is not considered), a low frequency component is removed from the waveform of column voltages, and a smooth change of picture image is obtainable even when changes in data of a picture image are frequent in a display of dynamic picture.

Description has been made as to an example of vector sequence wherein selection vectors are changed every selection of subgroups (for instance, the selection vectors undergo increment in a selection matrix). However, it is possible to use the same selection vectors in the selection of several subgroups. The longest of the same selection vectors is to be used for 2 subframes. This is the case that a vector 1 is used for the first and second scanning, and a vector 2 is used for next two scanning. This case substantially reduces the fundamental frequency of column voltage waveforms in comparison with the case that the vectors are changed every selection pulses as shown in Formula 13. The fundamental frequency can be adjusted by advancing periodically vectors every several times of selection. When the vector is advanced every W pulses, the fundamental frequency is 1/W times as much as the case of Formula 13.

The important items in achieving a high quality of display are summarized as follows.

1) The number of column voltage levels necessary for gradation levels to be displayed is appropriate (not too much), and 2) The frequency spectrum of column waveforms is not largely changed depending on display patterns.

The item 1) indicates a condition for preventing such disadvantage that when the number of column voltage levels is large, the waveform is complicated whereby there result crosstalking and inversion of gradation. The item 2) is for a condition for preventing crosstalking due to display patterns. An embodiment according to the present invention provides a novel method of forming a multi-gradation display by satisfying the above-mentioned conditions simultaneously. Namely, a multi-gradation display having high uniformity is achieved at a lower cost. The condition of 1) can be achieved by using the specified gradation levels as already mentioned in combination of the FRC technique. Further, when the multiple line selection method is used, an imaginary row and imaginary data corresponding thereto are used whereby the number of gradation levels displayed with respect to the number of column voltage levels can be further improved.

With respect to the condition 2), there are suitable waveform synthesizing methods as follows.

2-1) Column voltage levels based on divided data X and column voltage levels based on divided data Y are arranged in a mixed state in a scanning time. There are two kinds of technique for mixing the data X, Y in terms of a spatial size: one is to form a subgroup corresponding to X data and a subgroup corresponding to Y data in a scanning time, that is, mixing of units of subgroup, and the other is to distribute X data and Y data to lines in a simultaneously selected subgroup, that is, mixing of units of line. For mixing, either one or both of the above-mentioned techniques may be used.

2-2) Selection vectors used for forming selection pulses are regularly changed in a scanning time. For instance, the selection vectors are regularly shifted in the selection matrix. The period can be changed in a range from a selection pulse to the length two scanning.

2-3) The polarity of selection vectors is inversed with a period corresponding to a divisor of the number of subgroups or a period independent of the number of subgroups. Although this technique is used for determining a period for forming an alternate current, it can also control the frequency spectrum of column waveforms simultaneously.

The above-mentioned three techniques can control the frequency spectrum of column waveforms independently and effectively whereby occurrence of crosstalking due to the fact that the column waveforms strongly rely on display patterns, can be prevented. In particular, when a multi-gradation display as provided by the present invention is to be realized, a variation of voltage waveforms due to crosstalking fairly deteriorates the quality of picture images. This tendency is remarkable in displaying dynamic pictures. The method of forming gradation according to the present invention can provide a picture image of high quality at a lower cost in combination with the condition of 2).

Although the technique of increasing gradation levels in combination of the FRC method is most desirable in the present invention as described above, it is possible to increase the number of gradation levels with use of an error diffusion method or a dither method for forming a gradation display by utilizing spatial information.

Further for the FRC method, it is possible to utilize a conventional method. In particular, it is preferable to use a technique of spatial modulation wherein the phase corresponding to gradation data is changed between adjacent pixels in a plurality of frames, whereby a change of brightness with respect to time can be controlled and a multi-gradation display without flicker can be obtained. For instance, when 4 frames are used in the FRC method to effect a display in the present invention, the spatial modulation method may be used in combination, whereby a change of brightness with respect to time is not substantially recognized.

Circuit structure for realizing the present invention

Description will be made as to how to form a circuit for realizing the present invention.

The characteristic features of the present invention are to form many gradation levels in combination of the amplitude modulation method and the FRC method, and to form two or more divided gradation data by the amplitude modulation method to obtain column voltages. Accordingly, the basic circuit structure of the present invention can be formed by satisfying these points. Namely, in the basic structure of the present invention, there are a circuit for developing the gradation data to be displayed to a series of time sequentially developed gradation data, a circuit for transforming the developed gradation data (to be displayed by amplitude modulation) into divided gradation data, and a circuit for determining voltages to be applied to column electrodes. When the multiple line selection method is used, a circuit for forming sets of divided data from the gradation data to be displayed by the amplitude modulation which correspond to subgroups consisting of simultaneously selected row lines; a circuit for producing selection vectors applied to row electrodes, and a circuit for determining column voltages from the sets of divided data and selection vectors. These circuits are formed of logic circuits or ROMs. Further, some of the above-mentioned circuits may be formed integrally.

Gradation data are preferably stored in a memory in a form of gradation data. It is also possible to store the original gradation data to be displayed into the memory whereby column voltage signals to be supplied to a display are determined by means of the above-mentioned circuits, or to store as the gradation data to be displayed by amplitude modulation into the memory, or to store as the divided gradation data into the memory. Among these, the most effective technique from the viewpoint of the size of the memory, the power consumption rate and so on is to store in the memory in the form of gradation data to be displayed by amplitude modulation. With respect to this, several examples of the sequence are described below. The above-mentioned examples 3) indicates the case of using multiple line selection method.

1) 8 bit gradation data→a spatial gradation forming technique (error diffusion or dither method)→6 bit gradation data→time sequentially developing (4 frame FRC)→3 bits gradation data to be displayed by the amplitude modulation of 1 frame→memory→production of divided data→production of column voltages→display 2) 6 bit gradation data→time sequentially developing (4 frame FRC)→3 bits gradation data to be displayed by the amplitude modulation of 1 frame→memory→production of divided data→production of column voltages→display 3) 6 bit gradation data→time sequentially developing (4 frame FRC)→3 bits gradation data to be displayed by the amplitude modulation of 1 frame→memory→production of divided data (plural lines)→production of low selection pulses and column voltages (Ex-Or and adding calculation) →display The memory may be formed of a VRAM, a DRAM or the like as far as a wide width of data can be obtained. As described above, it is an effective way to calculate the gradation data to be displayed (6 to 8 bits) in space and time sequentially to reduce the number of bits and form amplitude modulation data of 1 frame (about 3 to 4 bits) to be stored in the memory. Of course, it is possible to calculate directly (without using memory) column voltage signals from the original gradation data. In this case, however, a large width of data and a high speed access time are required.

In examples 1)–3), a circuit for generating divided data is used to determine any one of a plurality of divided data from spatial information on columns and rows corresponding to the spatial modulation of FRC and information on time sequence (frame counter).

The structure of the circuit will be described in more detail.

In this embodiment, a picture signal treating circuit comprises a row selection pattern producing circuit, a frame modulation circuit for developing inputted picture signals in a plurality of time sequentially developed frames, a memory capable of storing the picture signals developed in the plurality of frames (gradation data corresponding to amplitude modulation) for an amount necessary to calculate the amplitude of voltages, a column voltage signal calculation circuit for operating column voltage signals from the picture signals from the memory and row selection pattern signals, and a timing producing device (a device for producing divided data X and Y) for identifying the picture signals in a specified frame among the plurality of developed frames and addressing the picture signals in either of the X subframe and the Y subframe. Thus, a multi-gradation display minimizing a flicker is obtainable.

Further, a frame modulation circuit which transforms picture signals including gradation into a plurality of time sequentially developed frame signals before the picture signals are transferred to the memory, is used whereby a data quantity per unit time can be reduced; a display minimizing a flicker is obtainable, and the number of memories can be reduced.

Further, the picture signal treating circuit may be formed as a integral circuit whereby the width of data for reading and writing in the memory can be wide and a memory having a low accessing speed (e.g. a DRAM) can be used.

Figure 5:
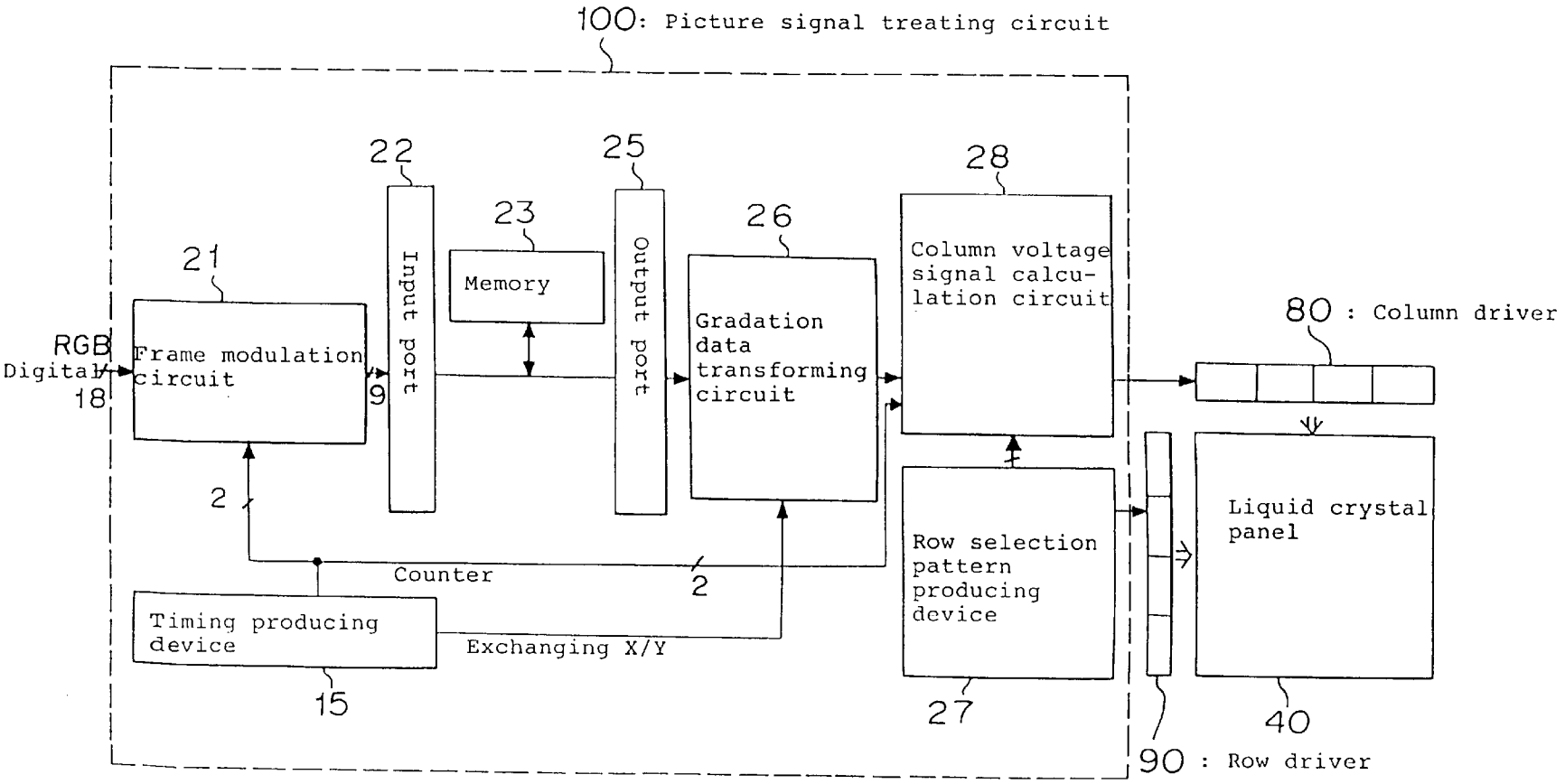
FIG. 5 is a block diagram showing a circuit for practicing the present invention.

FIG. 5 shows an embodiment of the picture signal treating circuit used for practicing the present invention.

A picture signal treating circuit 100 comprises a frame modulation circuit 21, an input port (shift resister), a memory (3Mbit DRAM) 23, an output port (shift resister) 25, a gradation data transforming circuit 26, a row selection pattern producing device 27, a column voltage signal calculating circuit 28 and a timing producing device 15.

The frame modulation circuit 21 transforms inputted gradation data of plural bits into gradation data correspondent to the amplitude modulation for plural frames. In this embodiment, 24 frames are used as described before. The transformation of data in the frame modulation circuit 21 is conducted by using look-up tables which correspond to from the first frame to the fourth frame. The transformation of data may be conducted by calculation without using the look-up tables.

The input port 22 transforms the gradation data corresponding to the amplitude modulation for frames, which are transferred from the frame modulation circuit 21 into parallel data for K pixels and transfers at one time a large amount of data to a memory at the later stage. As the value of K is large, an amount of data transferred at one time can be large. In this embodiment, a shift resister is used for the input port 22.

The memory 23 may be of any type as far as it has a capacity capable of storing data for an amount of a picture having a bit number necessary for calculation to form column signals at a late stage. In particular, since a picture signal treating circuit formed in an integrated form in which the memory is installed can store a large the width of data for reading and writing in the memory, a memory having a low access speed (e.g. a DRAM) can be used. Use of an economical DRAM is very advantageous in cost. Namely, in the present invention, use of the DRAM of a lower cost and a low speed is very useful from the viewpoints of a low power consumption rate and a low noise.

The output port 25 transfers data from the memory 23 to the column voltage signal calculation circuit 28. A shift resister is used for the output port in the same manner as the input port 22.

The gradation data transforming circuit 26 outputs gradation data corresponding to the divided data X and the divided data Y by using logic which are previously prepared for the X subframe and the Y subframe. The gradation data transforming circuit 26 may be formed of a selector and a logic circuit as shown in FIG. 27. The column voltage signal calculation circuit 28 produces column signals and outputs them. The outputted data are supplied as display data to the column drivers 80 in the liquid crystal display module. The row selection pattern producing device 27 produces row selection patterns based on the selection matrix. The row selection patterns are supplied to the row drivers 90 to form row voltages, and they also supplied to the column voltage signal calculation circuit 28 to be used for calculation for forming column voltage signals.

The timing producing device 15 is a control circuit which determines as to whether picture signals corresponding to a pixel are used for the X subframe or the Y subframe of a specified frame among a plurality of developed frames. Control signals are composed of frame signals and signals indicating a spatial information of pixels.

Display data supplied to the column voltage signal calculation circuit 28 are data arranged in the direction of column which have the same number as the number of simultaneously selected lines. The arrangement of the data supplied to the column voltage signal calculation circuit 28 is different from the order for transforming data from a display controller to the picture signal treating circuit 100.

Figure 6:
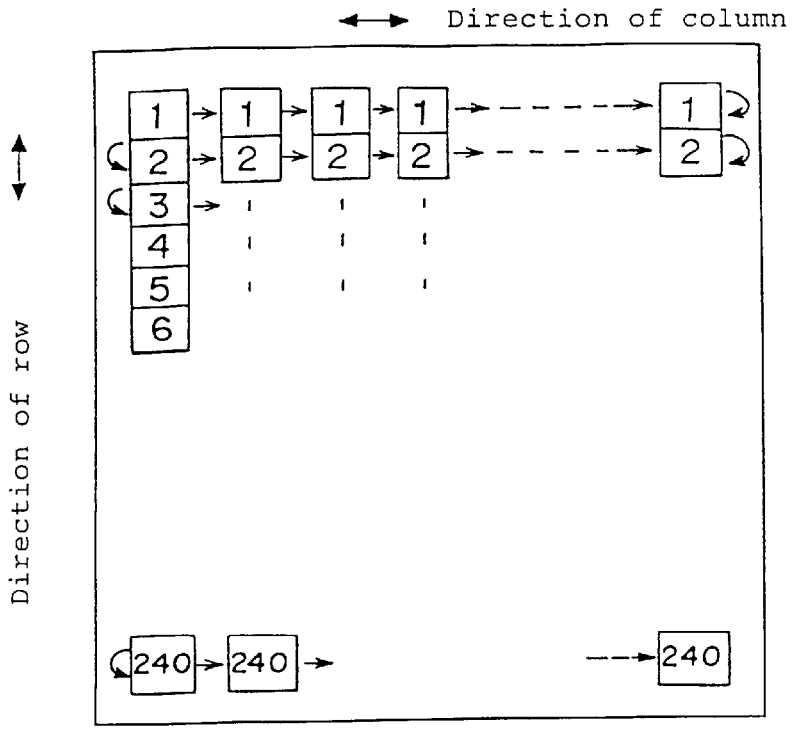
FIG. 6*a* is a diagram showing memory mapping for practicing a conventional technique.
FIG. 6*b* is a diagram showing memory mapping for practicing the the present invention.
Figure 6:
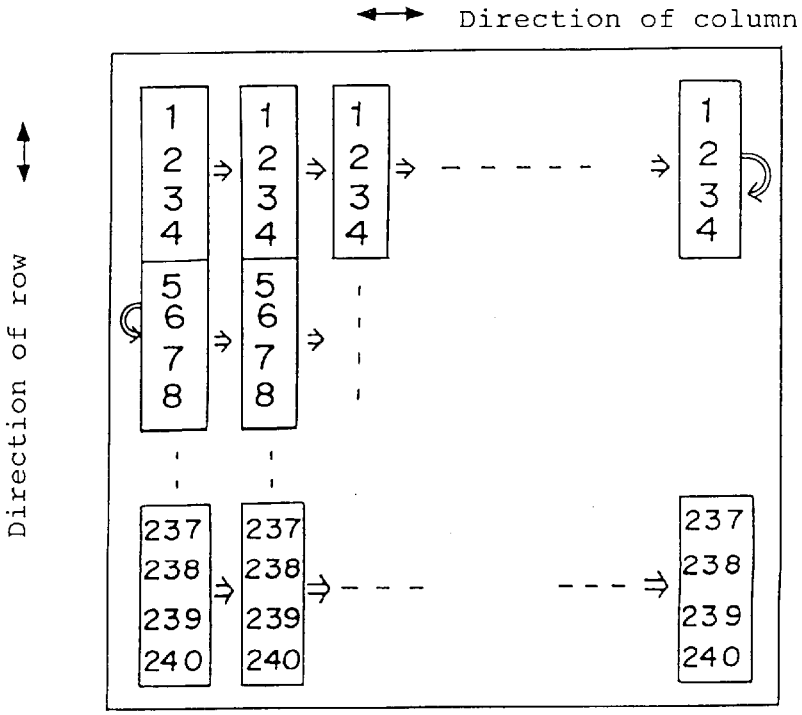
Figure 7:
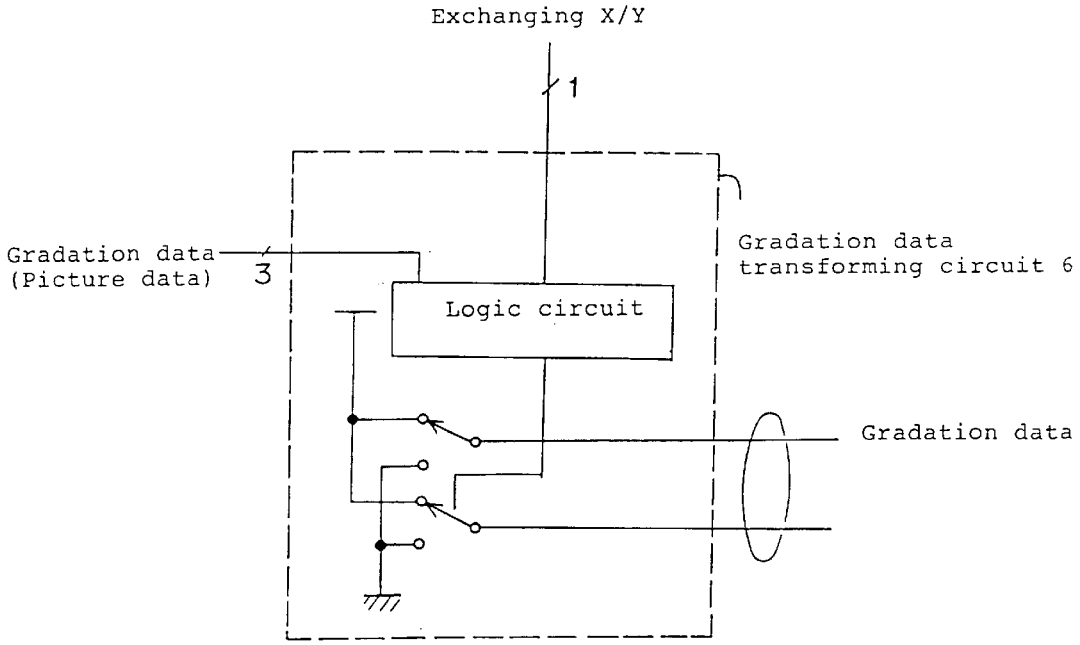
FIG. 7 is a circuit diagram of an embodiment of a gradation data transforming circuit in FIG. 5.

FIG. 6 is a diagram showing the difference. FIG. 6(*a*) shows the order of transferring data from the display controller to the picture signal treating circuit 100, and FIG. 6(*b*) shows the order of transferring data to the column voltage signal calculation circuit 28.

Picture signals inputted to the picture signal treating circuit 100 are usually transferred successively as a set of serial data of RGB (i.e. 1 pixel) so as to direct from the upper left portion of the picture surface toward the lateral direction. When all the data on the first row have been transferred, the data on the second row are taken. Thus, the data for a picture are supplied in the same manner as above.

A format for changing the order of transfer is changed at the time of reading or writing data in the memory. For instance, when data is written in the memory, writing is conducted by a predetermined format changed with use of a random access mode, and at the time of reading out, data are continuously read out at a high speed. Or, data are successively written at the time of writing, and reading is conducted by a predetermined format changed with use of the random access mode. In either case, the picture signal treating circuit can be formed in an integrated form in which the memory is installed whereby the width of data for reading and writing can be wide. Accordingly, a sufficient time for accessing the memory is obtainable by storing the serial data in the port so that the data can be treated as parallel data having a wide data width.

The operation of the circuit will be described.

The input signals from a flat panel display controller are RGB digital 18 bit signals which is same as signals through an interface for TFT module. The picture signal treating circuit 100 also receives horizontal synchronizing signals, vertical synchronizing signals, enabling signals, clock signals as well as data signals. The frame frequency is 60 Hz. Namely, 60 picture images are supplied in a second. 6 bit signals for RGB are inputted to the frame modulation circuit 21 in which the signals are transformed into 3 bit×RGB output signals by using frame data (2 bits) signals supplied from the timing producing device 15. In this transformation, the 6 bit picture data undergo frame modulation with respect to time and space. The outputted data of 23 bits×630×3×480 are written in the memory 23 through the input port 22.

Figure 10:
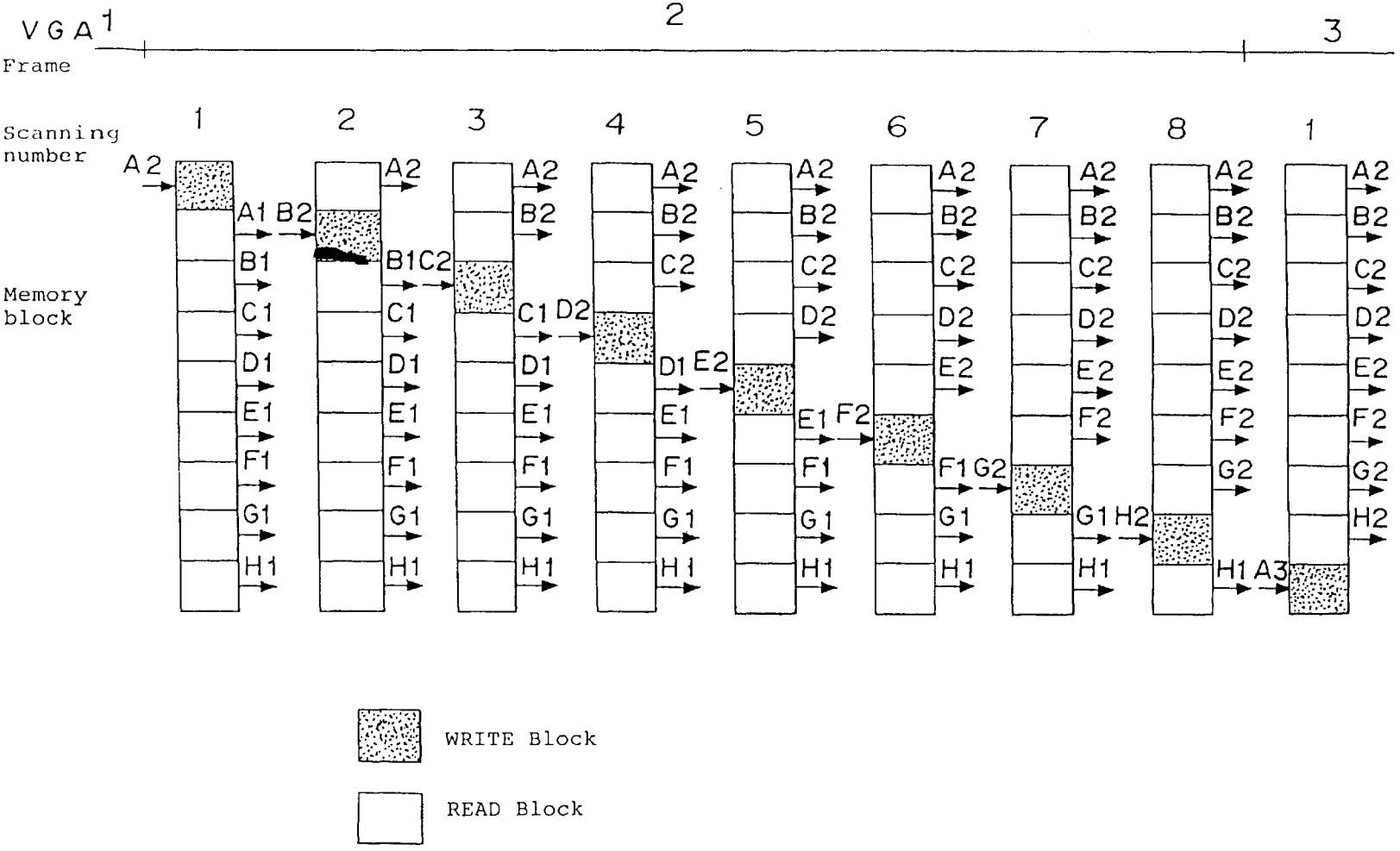
FIG. 10 is a diagram showing an idea of memory management for practicing the present invention.

FIG. 10 is a diagram showing an example of the structure of a memory space in a DRAM. The region of the DRAM is divided into 9 blocks, and the blocks are switched by addresses control. The block size is 72×630×3 (RGB)×3 bits (gradation information) in a case of VGA, or 84×800×3 (RGB)×3 bits (gradation information) in a case of SVGA.

For controlling, the upper portion of the liquid crystal display panel is divided into four regions A, B, C and D, and lower portion is divided into four regions E, F, G and H. In the case of VGA, the A region and the H region are respectively constituted by 24 lines, and others are respectively constituted by 72 lines.

As shown in FIG. 10, data in the regions A to H are usually read out in parallel from 8 blocks among 9 blocks, and data of a new VGA frame are written in the remaining one block. In a case of using an orthogonal matrix as a selection matrix of 4 columns, a VGA frame is constituted by 8 scans since there are two subframes X, Y in the VGA frame. During 8 scans, data in each block are constant, and accordingly, an voltage averaging method can be achieved.

Signals of 3 bits RGB, i.e., 9 bits in total for the first subframe among the first frames which undergo frame modulation are inputted to the gradation data transforming circuit 26 via the memory 23 the output port 25. Further, the gradation data transforming circuit 26 receives from the timing producing device 15 one-bit signals which designates the X subframe or the Y subframe with respect to the corresponding to pixel (in this case, the X subframe is designates). The gradation data transforming circuit 26 transforms the 3 bit gradation data into 2 bit gradation data depending on the designated frame X or Y (in this case, X subframe data). The 2 bit data correspond to ±1, ±1.4 which are mentioned before as the divided data X.

The 2 bit gradation data are inputted to the column voltage signal calculation circuit 28. To the column voltage signal calculation circuit 28, 4 bit data which correspond to the first column of the orthogonal function from the row selection pattern producing device 27 are inputted at the same time to select column voltages, whereby 3 bits×RGB column voltage data are outputted as the first scanning data.

8 times of scanning are conducted in the frame to finish one round. Usually, the frame frequency is about 60–75 Hz in which time a gradation display with amplitude modulation is finished. Then, the same treatment as above is conducted to the frame signals for the second sheet, for the third sheet, for the fourth sheet etc. whereby one display is completed.

Description has been so made that the above-mentioned sequence is based on the operation in synchronism with the input signals. However, it is not always that the sequence is in synchronism with the input signals. Further, when the frequency for transferring data to the module is 60 Hz or higher, the display data are constant in one frame term of the module, and accordingly, a voltage averaging method as the base of the passive addressing liquid crystal driving method is established.

Figure 8:
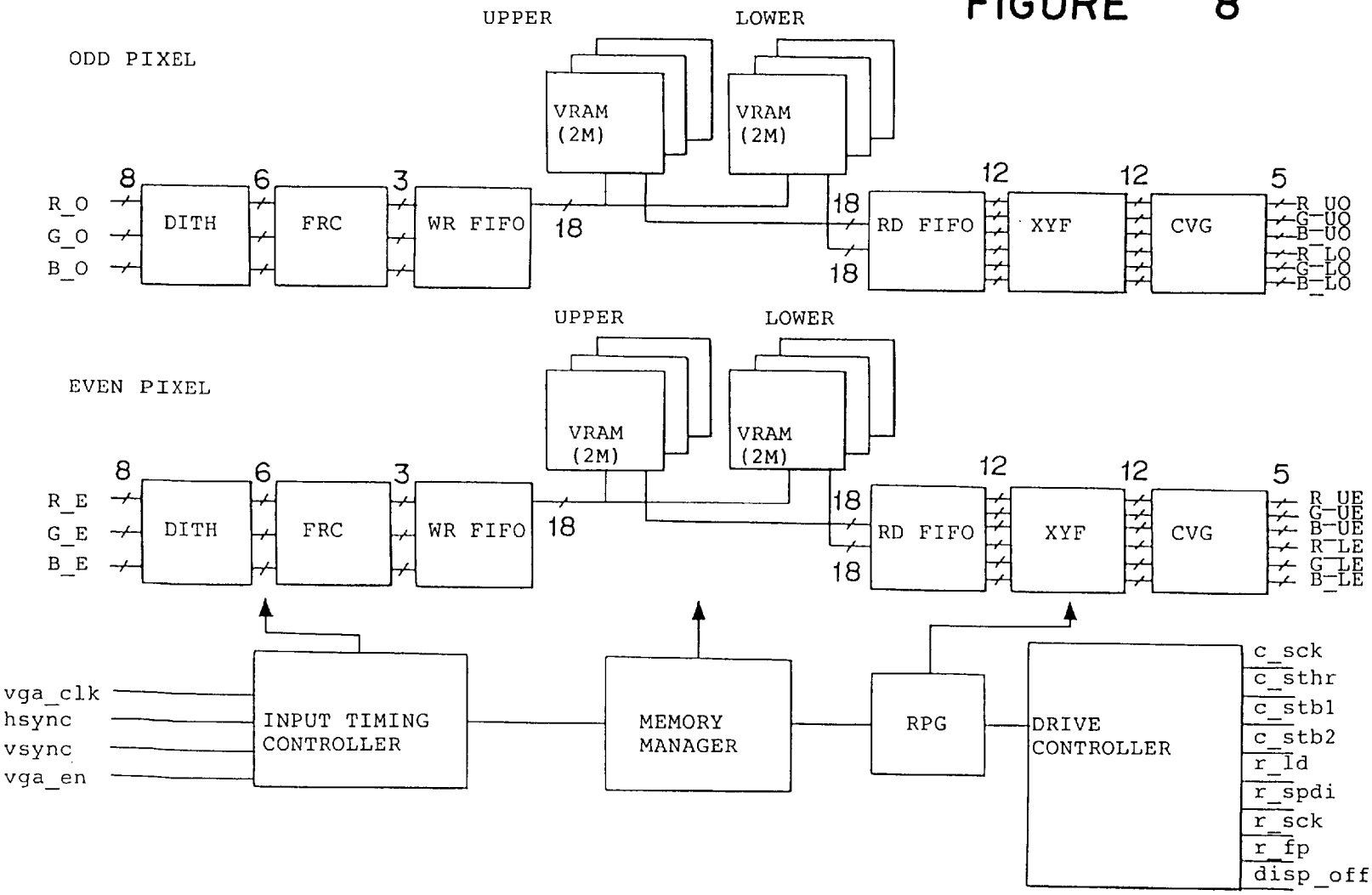
FIG. 8 is a block diagram of an embodiment of a circuit in an integrated form used for practicing the present invention.
Figure 9:
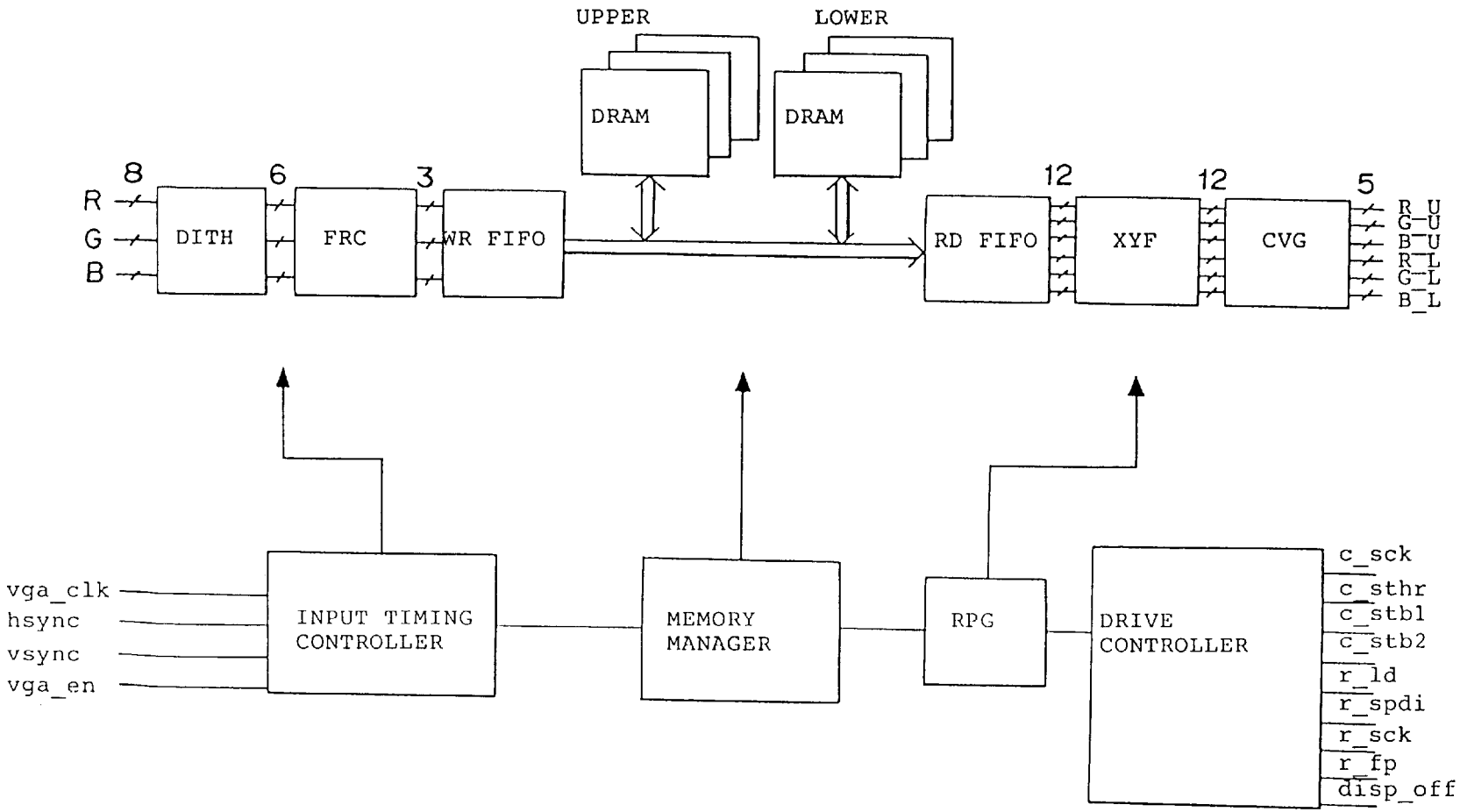
FIG. 9 is a block diagram of another embodiment of a circuit in an integrated form for practicing the present invention.

Thus, the driving of a video display is possible at a sufficient speed. Further, the frame modulation of data may be conducted before the writing in the memory. The data stored in the memory can be read out in synchronism with the frame frequency of the liquid crystal module whereby a display with little flicker can be obtained and the number of memories is reduced. When the picture image treating circuit 100 of the present invention is formed in a form of an integrated circuit which is mounted on the circuit substrate of the LCD module of the multiple line selection system, the interchangeability of an interface to a TFT module is possible. FIGS. 8 and 9 show examples of the construction of circuit in this case. FIG. 8 shows a structure comprising memories and other circuits, and FIG. 9 shows a structure comprising elements in which memories are installed. Of course, the picture image treating circuit can be mounted on the circuit substrate in a personal computer. Further, a part or the entirety of the circuit may be assembled on the chip of a column driver.

In FIGS. 8 and 9, explanation is made on the assumption that fullcolor digital inputs of 8 bits×3 (RGB) are used as input signals. The number of lines simultaneously selected is 4. In the signals, two bits of a lower position in the input data of each 8 bits for R, G or B are used for a dither treatment (a gradation method by spatial modulation), and 6 bits of an upper position are used for a gradation method by frame modulation and amplitude modulation. Namely, each of the 8 bits input data are converted into 6 bit data in a dither circuit (DITH) and outputted therefrom. 6 bit data are further converted into 3 bit data in a frame modulation circuit (FRC), and the 3 bit data are supplied to an input port (WRFIFO).

The circuit shown in FIG. 8 receives as inputs data (ODD PIXEL) on the column electrodes of odd number in the lateral direction of the picture surface in parallel to data (EVEN PIXEL) on column electrodes of even number, whereby the operating frequency of the circuit is reduced. Accordingly, there are two circuit systems, which are identical, for treating the data for odd numbers and even numbers. In the specification, one of the data flow is explained. However, the other data flow is the same.

FIG. 8 shows such a type of circuit wherein memories are attached to the outside of IC. An input port (WR FIFO) stores data for two pixels, namely, data of 2×3×3 (RGB)=18 bits which are supplied to memories VRAM. As the memories, there are two systems, i.e. one for data of an upper half (UPPER) and one for data of a lower half (LOWER), which perform reading operation in parallel. Namely, data of 36 bits in total of the upper and lower half portions are simultaneously read out, and the read out data are supplied to an output port (RD FIFO) in which the data are transformed into data on two pixels (data of 72 bits in total). Then, the data are supplied to a gradation data transforming device (XYF) which receives from a row pulse generator (RPG) one bit signal which designates one of the X subframe and the Y subframe. In accordance with the designation of either the X subframe or the Y subframe, 72 bits in total are supplied to a column voltage signal calculation circuit (CVG). The column voltage signal calculation circuit receives row selection pattern signals at the same time, in which column voltage signals are calculated by using the before-mentioned input data. The calculation circuit (CVG) outputs to liquid crystal drivers 5 bit output signals for upper and lower halves and RGB, i.e. 5×2×3=30 bit signals.

FIG. 9 shows such a type of circuit having memories included in IC (including DRAM). The major different features from the circuit in FIG. 8 are that the width of data supplied to the memories is extremely large, and the operating speed is slow to permit use of DRAM. Accordingly, it is possible to reduce power consumption rate and manufacturing cost. It is therefore preferable that the width of data is large as far as IC process is possible. For instance, use of 128 bits or 256 bits is effective. The bit width of the input port and output port should be large in response to the width of data.

Now, the present invention will be described in detail with reference to examples. However, it should be understood that the present invention is by no means restricted by such specific examples.

EXAMPLE 1

A VGA liquid crystal display panel of 480×640×RGV was prepared. In forming the display module of liquid crystal panel, 240° twisted STN was used; phase compensation was effected with two phase compensation films; an inner color filter was combined to provide a colored display, and a fluorescent tube backlight was arranged at the rear surface of the panel. All scanning lines (selection lines) were vertically divided into two portions to employ a dual scan driving system. A successive line method (APT) was used to select each of the selection lines for gradation. Amplitude modulation was used in association-with frame modulation to thereby obtain a display of 21 gradation levels. 5 bit data (for 32 gradation levels) were inputted. After γ correction, the data was distributed to 21 gradation levels, and the 21 gradation levels were distributed to 7 gradation levels for AM and frame modulation for two frames. The 7 gradation levels for AM were ±1, ±0.8, ±0.6 and 0 correspond to the conditions: $d_1$=0.8 and $d_2$=0.6 in Table 1. AM data and column voltage levels in the frames were as shown in FIG. 1 and Table 4. Each frame was divided into an X subframe and an Y subframe. The X subframe was applied with voltages corresponding to the divided data X in Table 3, as column voltages, and the Y subframe was applied with voltages corresponding to the divided data Y in Table 3, as column voltages (where $d_1$=0.8 and $d_2$=0.6). The polarity of signal voltages was inverted every 13 selection pulses.

The driving frequency was so adjusted that the width of selection pulses was 35 μs (i.e., subframe frequency=120 Hz) and the bias ratio was 1/14. As column drivers, 8 level (3 bits) drivers were used. Row drivers were of ordinary used 3 levels (±VR, 0).

Table 11 shows the characteristics obtained in the above-mentioned driving method. The response time is the average time between the rising time and the falling time. The definition is also applicable to Examples 2 and 3 and Comparative Example 1.

A VGA output from a personal computer was used as an input of signals for driving. As a result, a display of fine gradation was obtained. Further, a display was conducted by inputting video signals in a personal computer. As a result, a display of dynamic picture excellent in gradation was obtained although there were some residual images.

EXAMPLE 2

A VGA liquid crystal display panel was prepared in the same manner as Example 1 provided that a further high speed response type VGA panel (240° twisted film compensation type STN) of 480×640×RGB was used. The panel was driven as described below.

All scanning lines (selection lines) were divided vertically into two portions to employ a dual scan driving system. A multiple line selection method was used to select each three lines simultaneously. Accordingly, 240 selection lines were divided into 80 subgroups, and a series of selection pulses was determined with use of a 3×4 orthogonal matrix as shown in Table 7 so that the voltage effective values were determined when each of the subgroups was selected four times.

For gradation, amplitude modulation and frame modulation were used together to obtain a display of 21 gradation levels in the same manner as Example 1. 5 bit data (for 32 gradation levels) were inputted. After γ correction, the data were distributed to 21 gradation levels. The 21 gradation level data were distributed to 7 gradation levels for AM and the frame modulation for two frames. The 7 gradation data of AM were ±1, ±0.8, ±0.6 and 0 which are correspond to the condition of $d_1$=0.8 and $d_2$=0.6 in Table 1. The AM data and the column voltage levels in the frame are shown in Table 4. The AM 7 gradation data were $d_1$=0.8 and $d_2$=0.6 which were distributed to the X subframe and the Y subframe as shown in Table 3.

The polarity of data signals was inverted after two frames (4 subframes) have been completed. The X subframe was applied with voltage levels obtained by calculating the divided data X in Table 3, as column voltages, and the Y subframe was applied with voltage levels obtained by calculating the divided data Y in Table 3, as column voltages.

The driving frequency was so adjusted that the width of selection pulses was 35 $\mu$s (i.e., subframe frequency=120 Hz), and the maximum bias ratio (row voltage/maximum column voltage) was 1/5. As column drivers, 32 level (5 bits) drivers were used (in this case, 20 levels were used), and row drivers were of ordinary used 3 levels ($\pm V_R$,0).

Table 11 shows the characteristics obtained by using the above-mentioned driving method.

A VGA output from a personal computer was used as a signal input for driving. As a result, a display of fine gradation was obtained. Further, video signals were inputted to a personal computer for display. As a result, a display of dynamic picture excellent in gradation and free from residual images could be obtained.

Further, in either a display of static picture by the windows or a display of dynamic picture using video signals, an excellent display of picture images was obtained, which was of higher contrast ratio and less crosstalking than Example 1.

Further, when 6 bit (64 gradation levels) data were used as an input, and the 6 bit data are distributed to the frame modulation for 4 frames and the AM modulation for 7 gradation levels, a display of 41 gradation levels could be obtained.

EXAMPLE 3

The same liquid crystal display panel as in Example 1 was used. In driving, column voltage levels as specified in Table 9 were used. Namely, 7 display data: 1, 0.866, 0.5, 0, −0.5, −0.866 and −1 were used.

TABLE 9

| AM gradation | Divided data X | Divided data Y |
|---|---|---|
| 1 | 1 | 1 |
| 2 | 1.366 | 0.366 |
| 3 | 1.366 | −0.366 |
| 4 | 1 | −1 |
| 5 | −1.366 | 0.366 |
| 6 | −1.366 | −0.366 |
| 7 | −1 | −1 |

The characteristics obtained for the module are shown in Table 11.

The 21 gradation levels in the two frames had no equal intervals.

The number of input bits was changed to 6 bits (64 gradation levels) and the 64 bit data are distributed to the frame modulation for 4 frames and the AM modulation for 7 gradation levels. In conducting a display, a gradation display having equal intervals was obtained and the number of gradation was 61.

Comparative Example 1

The same VGA liquid crystal display panel of 480×640×RGB (240° twisted film compensation type STN) as in Example 1 was driven in the following manner.

All scanning lines (selection lines) were vertically divided into two portions to employ a dual scan driving system. A successive line method (APT) was used to select each line of selection lines. For gradation, the amplitude modulation and the frame modulation were used together to effect a display of 15 gradation levels. In displaying gradation, 4 bit data (for 16 gradation levels) were inputted to be distributed to 15 gradation levels. The 15 gradation level data were distributed to 8 gradation levels for AM the frame modulation for 2 frames. The 8 gradation levels by the AM modulation were composed of numerical values having equal intervals in a range between a display data −1 (ON) and a display data +1 (OFF).

The polarity of data signals was inverted every 13 selection pulses. Each of the frames was divided into the X subframe and the Y subframe wherein the X subframe was applied with voltages corresponding to the divided data X and the Y subframe was applied with voltages corresponding to the divided data Y. The driving frequency was so formed that the width of selection pulses was 35 $\mu$s (i.e., subframe frequency=120 Hz) and the bias ratio was 1/14.

The characteristics obtained by the above-mentioned driving method are shown in Table 11.

As column drivers, 16 level (4 bits) drivers were used wherein 14 levels were used, and as row drivers, ordinary used three level ($\pm V_R$, 0) row drivers were used.

A VGA output from a personal computer was used as an signal input for driving. As a result, a display of fine gradation was obtained. Further, when video signals were input to a personal computer for display, a display of dynamic picture with slight residual images could be obtained. However, the quality of the display was lower than those in Examples 1, 2 and 3.

Table 9 shows the number of column voltage levels and number of gradation levels concerning the above-mentioned Examples and Comparative Example.

TABLE 10

| | Column voltage | Driving method | 2 frame gradation | 4 frame gradation |
|---|---|---|---|---|
| Example 1 | 6 levels | APT | 21 gradation | 41 gradation |
| Example 2 | 20 levels | multiple line selection | 21 gradation | 41 gradation |
| Example 3 | 6 levels | APT | 21 gradation | 61 gradation |
| Comparative Example 1 | 14 levels | APT | 15 gradation | 29 gradation |

TABLE 11

| | Example 1 | Example 2 | Example 3 | Comparative Example 1 |
|---|---|---|---|---|
| Contrast ratio | 30:1 | 50:1 | 30:1 | 30:1 |
| Response time | 150 ms | 70 ms | 150 ms | 150 ms |

EXAMPLE 4

A VGA liquid crystal display panel of 480×640×RGB was prepared. In forming the display module of the liquid crystal display panel, a 240° twisted STN was used; phase compensation was effected with two sheets of phase compensation films; an inner filter was combined to obtain a colored display, and a fluorescent tube backlight was disposed at the rear surface.

All scanning lines (selection lines) were vertically divided into two portions for dual scan driving. A multiple line selection method was used to select three lines simultaneously for driving. Accordingly, 240 selection lines were divided into 80 subgroups. A series of selection pulses was determined with use of the 4×4 orthogonal matrix as shown in Table 8. A single imaginary line was provided in each of the subgroups so that four lines was simultaneously selected imaginarily for driving.

For gradation, amplitude modulation and frame modulation were used together to obtain a display of 21 gradation levels. 5 bit data (32 gradation levels) were inputted. After γ correction, the data were distributed to 21 gradation levels, and the 21 gradation level data were distributed to 7 gradation levels for AM and the frame modulation for 2 frames. The 7 gradation data displayed by AM were ±1, ±0.8, ±0.6 and 0. The display data were distributed for each of the frames by the frame modulation as shown in Table 4. Further, the 7 gradation data by AM were distributed to the X subframe and the Y subframe.

Imaginary data on the imaginary lines were calculated with use of the data on actual three lines by using the following three conditions, and calculations on the matrix were effected in accordance with signals from a row (selection) function generator to thereby obtain column voltage levels corresponding to selection pulses of 6 levels. The obtained data were transferred as 3 bit signals to column drivers.

Condition 1: In subframes having an odd number, data ±1, ±1.4 were used as divided data X for 1 line, and in subframes having an even number, ±1, ±0.2 were used as divided data Y for 1 line.

Condition 2: Data on imaginary lines are so determined that the number of ±1 as the divided data for four lines has an even number.

Condition 3: Data on imaginary lines are so determined that the number of a negative sign on the divided data for four lines has an even number.

The polarity of data signals was inverted after operations to two frames (4 subframes) have been finished. Column voltages obtained by the calculation of the divided data X in Table 3 were applied to the X subframe, and column voltages obtained by the calculation of the divided data Y in Table 3 were applied to the Y subframe.

The driving frequency was so determined that the width of selection pulses was 35 μs (i.e., subframe frequency=120 Hz) and the maximum bias ratio (row voltage/maximum column voltage) was 1/5. For column drivers, 8 level (3 bit) drivers were used (actually 6 levels were used), and ordinary three levels ($\pm V_R$, 0) were used for row drivers.

In the characteristics obtained by the above-mentioned driving method, the contrast ratio was 40:1 and the response time (average) was 70 ms.

A VGA output from a personal computer was used as a signal input. As a result, a display having fine gradation was obtained. Further, when video signals were input to a personal computer to display the signal data, a display of dynamic pictures having excellent gradation was obtained while there was few residual images.

In either display of static pictures by windows or display of dynamic pictures using video signals, excellent picture images were obtained and a display having a high contrast ratio while minimizing crosstalking was obtained.

Further, 6 bit data (64 gradation levels) were used as input data, and the data were distributed to frame modulation for four frames and AM modulation for 7 gradation levels. When the data were displayed, a display having 41 gradation levels was obtained.

EXAMPLE 5

In the same manner as Example 4, the liquid crystal display element was driven provided that the selection matrix as shown in Table 12 was used.

TABLE 12

$$\begin{bmatrix} 1 & 1 & 1 & 1 \\ 1 & -1 & 1 & -1 \\ 1 & 1 & -1 & -1 \\ 1 & -1 & -1 & 1 \end{bmatrix}$$

The manner of determining imaginary data was partially changed in accordance with a change of the selection matrix. Namely, the data on imaginary lines were so determined that the number of negative signs on divided data for four lines had an odd number although the number of negative signs on the divided data for four lines had an even number in the condition 3 of Example 4.

The characteristics of the module obtained were the same as those in Example 4, and substantially the same quality of picture images as in Example 4 was obtained.

EXAMPLE 6

In Example 4, an imaginary subgroup was added so that the number of subgroups was 81 and the jumping sequence of column vectors in the selection matrix was eliminated. In this case, the polarity of data signals was inversed every 13 selection pulses. Further, the 7 gradation data by AM and FRC for 2 frames were used together, and the AM data were dispersed with respect to space and time in order to prevent occurrence of a flicker. Specifically, the data expressed in the first frame and the second frame were divided to pixels of 2×2 on the display surface, as shown in Table 13.

TABLE 13

| 1 FR | | 2 FR | |
|---|---|---|---|
| 1 | 2 | 2 | 1 |
| 1 | 2 | 2 | 1 |

Further, the divided data X was exchanged to the divided data Y every selection of 5 subgroups in a scanning time. Namely, the column voltage sequence vectors ($c_{X+Y}$) as shown in Formula 12 were used.

With use of the above-mentioned technique, crosstalking in a half tone area was remarkably reduced. Further, a phenomenon of inversion of brightness to the original gradation levels (effective voltage levels) was substantially suppressed.

EXAMPLE 7

The same technique of driving as shown in Example 6 was taken except that signals based on the divided data X and divided data Y which were formed by the orthogonal transformation with the same column vectors in the selection matrix were successively applied to specified row electrode groups, each of which were simultaneously selected, in response to a timing of selection pulses. Namely, the column voltage sequence vectors ($c_{X+Y}$) were used.

By using such technique, a vertical stripe-like uneven portion in a dynamic picture which occurred in AM was greatly reduced. As a result, when a display was effected with video signals, a display of excellent quality was obtained while there was little crosstalking.

EXAMPLE 8

A VGA liquid crystal display panel of 480×640×RGB was prepared. The display module of the liquid crystal panel was formed as follows. A 240° twisted STN was used: phase compensation was effected with two sheets of phase compensation films; an inner color filter was combined to obtain a colored display, and a fluorescent tube backlight was disposed at the rear surface.

All scanning lines (selection lines) were vertically divided into two portions for dual scan driving. A multiple line selection method was used to select two lines simultaneously. Accordingly, 240 selection lines were divided to 120 subgroups. A series of selection pulses was determined with use of a 2×4 orthogonal matrix based on two 2×2 orthogonal matrices as shown in Table 14. Accordingly, with respect to ON and OFF data, the effective voltage values were fixed when each of the subgroups has been selected twice, and with respect to data of intermediate tones, the effective voltage values were fixed when each of the subgroups was selected 4 times.

TABLE 14

$$\begin{bmatrix} 1 & 1 & 1 & -1 \\ 1 & -1 & 1 & 1 \end{bmatrix}$$

The reason why the vectors as in Table 14 is used is that frequency components in the row waveforms between simultaneously selected two row lines are made equal, whereby the uniformity of voltages in the direction of rows can be obtained. In the above matrix, columns (selection vectors) from the left side to the right side are called A1–A4 respectively.

For gradation, amplitude modulation and frame modulation were used together to effect a display of 21 gradation levels. 5 bit data (32 gradation levels) were input. After γ correction, the data were distributed to 21 gradation levels, and the 21 gradation data are distributed to 7 gradation levels by AM and frame modulation for 2 frames. Data ±1, ±0.8, ±0.6 and 0 were used for 7 gradation levels displayed by AM. The display data as shown in Table 4 were distributed to the frames by the frame modulation. Further, the 7 gradation data by AM were divided for display to X data and Y data as divided data.

The relation of the X data or the Y data to scanning operations in specified frames depended on subgroups. The X data were used for the first scanning for the first to the 5 th subgroups, and the X data were used for the first scanning for the next 5 subgroups. Further, the X data were exchanged with the Y data in the next scanning.

In this case, the selection vectors used for the first scanning were made equal to those in the second scanning, and selection vectors used in the third scanning were made equal to those in the fourth scanning so that the selection vectors were changed every two scanning. Further, the selection vectors were regularly changed every 3 turns of selection so that there was a series of selection vectors, A1, A1, A1, A2, A2, A2, A3, A3, A3, . . . , in the first and second scanning, and there was a series of selection vectors, A2, A2, A2, A3, A3, A3, . . . , in the third and fourth scanning. The selection vectors and the divided data as shown in Table 15 are applied to the first subgroup in the respective scanning.

TABLE 15

| Frame number | Scanning number | Selection vector | Divided data |
|---|---|---|---|
| 1st frame | 1st scanning | A1 | X |
| | 2nd scanning | A1 | Y |
| | 3rd scanning | A2 | X |
| | 4th scanning | A2 | Y |
| 2nd frame | 1st scanning | A3 | X |
| | 2nd scanning | A3 | Y |
| | 3rd scanning | A4 | X |
| | 4th scanning | A4 | Y |

The polarity inversion was made every 31 pulses independent of the above-mentioned sequence.

Column signals were obtained by calculating the selection vectors and the divided data. As column drivers, 4 bit (16 level) drivers were used.

In the characteristics obtained in the above-mentioned driving method, the contrast ratio was 35:1 and the response time (average) was 70 ms.

A VGA output from a personal computer was used as a signal input. As a result, a display of fine gradation was obtained. Further, video signals were input for display to a personal computer. As a result, a display of dynamic pictures excellent in gradation could be obtained while there was substantially no residual images.

In either of a display of static pictures by windows or a display of dynamic picture using video signals, excellent picture images was obtained, and a display having a high contrast ratio and little crosstalking could be obtained.

Further, 6 bit (64 gradation levels) data were distributed to frame modulation for 4 frames and AM modulation for 7 gradation levels. In displaying the data, a display of 41 gradation levels could be obtained.

EXAMPLE 9

Picture images were displayed by using substantially the same driving method as example 8 except that the exchange of the X data and Y data were done in the subgroups and between subgroups. Further, dummy subgroups were inserted into exchanged portions of X and Y data between subgroups, and data on the next subgroups were used as imaginary data on the electrodes in the dummy subgroups, whereby unevenness of brightness between subgroups due to a distortion of the waveforms which might result from the exchange of X and Y data in the subgroups could be removed. The exchange of the X and Y data between the subgroups was conducted every 20 subgroups. For this, all the subgroups were divided into 6 blocks, and 6 dummy subgroups (12 imaginary lines) were provided.

In the first scanning for the first frame in the first block, the X data were distributed to the first line and the Y data were distributed to the second line, wherein the first and the second lines were simultaneously selected. In the second block, the Y data were distributed to the first line and the X data were distributed to the second line. In the next scanning, the X and Y data were exchanged.

The driving duty was 1/252. However, substantially the same characteristics as in Example 8 could be obtained, and picture images having high uniformity could be obtained.

EXAMPLE 10

Picture images were displayed by using substantially the same driving method as in Example 8. However, for gradation, two kinds of gradation data set corresponding to amplitude modulation, which were time sequentially developed by FRC were used. A display of gradation data was effected in such a manner that for column lines having an odd number, gradation data A were used for odd number frames while gradation data B were used for even number frames, and for column lines having an even number, gradation data B were used for odd number frames while gradation data A were used for even number frames. A(1, 0.8,0.6,0,−0.6,−0.8,−1) and B (1,0.88,0.47,0,−0.47,−0.88,−1) were used for the gradation data A and B. With use of FRC for 2 frames, a display having more than 40 gradation levels could be obtained. The number of gradation levels was greatly increased in comparison with 21 gradation levels which was obtained by using only the gradation data A. In this example, 5 bit column drivers were used wherein 27 levels were used.

EXAMPLE 11

Picture images were displayed by using substantially the same driving method as in Example 8.

As gradation data for one frame, (1,0.8,0.6,0,−0.6,−0.8,−1) were used. A gradation display was conducted by changing the absolute value of the amplitude of row voltages between odd number frames and even number frames. In this case, the row voltages in the even number frames were determined to be 0.75 times as much as those of the odd number frames.

Substantially the same contrast as in Example 8 could be obtained. A display of 44 gradation levels was obtained with 2 frames and a display of more than 100 gradation levels was obtained with 4 frames.

In accordance with the present invention, gradation driving utilizing amplitude modulation is possible while the number of levels for column drivers is maintained in 20 a realistic range of level (64-32 levels or lower).

Namely, a gradation display free from a flicker, simplification of the circuit system and reduction of manufacturing cost can be achieved.

Further, a display can be effected independently without data error. A picture image of high quality can be presented without a special treatment of data. Namely, a picture image can be obtained without information error such as crosstalking.

Further, the maximum level of column voltages can be controlled to be low whereby power consumption rate can be reduced; a change of voltage which may cause an ununiformity of display is made small, and a display of high quality can be obtained.

The present invention is very effective for the multiple line selection method.

We claim:

1. A driving method for a liquid crystal display device having accessible display portions forming pixels, using a multiplex driving method which comprises:

applying to said pixels groups of voltage pulses having respective group pulse heights which vary in at least two different groups depending on gradation levels of data to be displayed, at least two of said respective group pulse heights having a different absolute magnitude in at least one of the at least two of the groups with the respective group pulse heights in the groups including components having a value such that RMS voltages applied to said pixels on scanning electrodes in a non-selection state are effectively made constant in a display frame period, and using at least one common pulse height in the at least two of the groups, whereby the number of pulse heights used in all of the groups to cause display of all desired gradation levels is reduced.

2. A driving method according to claim 1, further comprising the step of displaying said gradation levels in association with a frame modulation or a pulse width modulation.

3. A driving method according to claim 1 further comprising simultaneously selecting a plurality of scanning electrodes and applying display inducing pulses to the selected scanning electrodes defined by a selection matrix having a substantial orthogonality.

4. A driving method according to claim 3, further comprising adding at least one imaginary scanning electrode to the simultaneously selected scanning electrodes, and determining data for the imaginary scanning electrode so that the number of voltage levels to be applied to data electrodes is reduced.

5. A driving method for a liquid crystal display device having accessible display portions forming pixels, and using a multiplex driving method which comprises:

applying to said pixels groups of voltage pulses, wherein at least one of the groups has at least two pulses with different absolute magnitude pulse heights, wherein each of the groups correspond to one of a plurality of achievable display gradation data levels provided as including components having variable levels such that RMS voltages applied to said pixels on scanning electrodes in a non-selection state are effectively made constant in a display frame period, and using a part of the divided gradation data commonly relative to at least the at least two groups to provide at least two different display gradation data levels for display.

6. A driving method according to claim 5, further comprising displaying said display gradation data levels in association with a frame modulation or a pulse width modulation.

7. A driving method according to claim 5, further comprising obtaining said display gradation data levels in at least said at least two groups as at least two voltage pulses including pulse heights which vary depending on the display gradation data levels to be displayed and correspond to at least a part of a range of levels from −1 to +1 divided into substantially equal intervals.

8. A driving method according to claim 5, wherein said gradation data levels d span a range from −1, which indicates ON, to 1, which indicates OFF, said gradation data levels being effectively displayed by displaying first and second divided gradation data $d\pm\sqrt{1-d^2}$.

9. A driving method according to claim 5, wherein a plurality of scanning electrodes are simultaneously selected, and pulses applied to the selected scanning electrodes are defined by a selection matrix having a substantial orthogonality.

10. A driving method according to claim 9, wherein the data electrodes corresponding to the simultaneously selected scanning electrodes are applied with signals which are obtained by transforming the divided gradation data with said selection matrix.

11. A driving method according to claim 9, wherein said gradation data levels d span a range from −1, which indicates ON, to 1, which indicates OFF, said gradation data levels being effectively displayed by displaying first and second divided gradation data $d\pm\sqrt{1-d^2}$ gradation data $\pm d\sqrt{-1-d^2}$, wherein.

12. A driving method according to claim 11, wherein when the intermediate gradation data are displayed, signals which are applied to the data electrodes in response to selection pulses in a time period wherein all the scanning electrodes are applied with at least one selection pulse include in a mixed state at least one signal which is obtained by the orthogonal transformation of a data element having the absolute value exceeding 1 among the divided gradation data and at least one signal which is obtained by the orthogonal transformation of a data element having the absolute value less than 1.

13. A driving method according to claim 11, wherein when the intermediate gradation data are displayed, signals which are applied to the data electrodes in response to selection pulses applied once to a simultaneously selected scanning electrode group include in a mixed state at least one signal which is obtained by the orthogonal transformation of a data element having the absolute value exceeding 1 among the divided gradation data and at least one signal which is obtained by the orthogonal transformation of a data element having the absolute value less than 1.

14. A driving method according to claim 9, wherein when signals are applied to the data electrodes with respect to a simultaneously selected scanning electrode group, the signals are formed by the orthogonal transformation of all the divided gradation data necessary for displaying a predetermined gradation data, and the signals are successively applied as a group for each of column vectors of the selection matrix, to the column electrodes in response to a timing of the application of the selection pulses.

15. A driving method according to claim 9, wherein at least one imaginary scanning electrode is added to the simultaneously selected scanning electrodes, and data are determined for the imaginary scanning electrode so that the number of voltage levels to be applied to data electrodes is reduced.

16. A driving method according to claim 15, wherein the display data corresponding to the simultaneously selected scanning electrodes, which include at least one imaginary scanning electrode are divided into plural groups of display data having different absolute values; and data are determined for the at least one imaginary scanning electrode so that the number of display data included in each of the groups takes a predetermined discrete integer value.

17. A driving method according to claim 15, wherein the product of the column vector elements in the selection matrix takes a predetermined sign, and data are determined for the imaginary scanning electrodes so that the product of the display data elements corresponding to the simultaneously selected scanning electrodes, which include at least one imaginary scanning electrode, takes a predetermined sign.

18. A method for driving a liquid crystal display device so that the number of voltage levels applied to data electrodes is reduced, comprising:

simultaneously selecting a plurality of scanning electrodes;

applying signals to data electrodes corresponding to the simultaneously selected scanning electrodes, said signals being obtained by transforming gradation data with a substantially orthogonal selection matrix, the gradation data being composed of at least two kinds of data elements having different absolute values;

adding at least one imaginary scanning electrode to the simultaneously selected scanning electrodes;

determining gradation data for the at least one imaginary scanning electrode to be one of the at least two kinds of data elements and the number of each data element being one of a predetermined discrete integer.

19. A driving method according to claim 18, wherein a product of column vector elements in the selection matrix has predetermined sign, and data are determined for the at least one imaginary scanning electrode so that the product of the display data elements corresponding to the simultaneously selected scanning electrodes and the at least one imaginary scanning electrode has a predetermined sign.

* * * * *